US008863318B2

(12) United States Patent
Strong

(10) Patent No.: US 8,863,318 B2
(45) **Date of Patent: *Oct. 21, 2014**

(54) ACTIVE HEAD COVERING WITH MOVEABLE ELEMENT

(71) Applicant: Finn Alexander Strong, San Rafael, CA (US)

(72) Inventor: Finn Alexander Strong, San Rafael, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/953,711

(22) Filed: Jul. 29, 2013

(65) Prior Publication Data

US 2013/0340144 A1 Dec. 26, 2013

Related U.S. Application Data

(63) Continuation-in-part of application No. 13/772,316, filed on Feb. 20, 2013, now Pat. No. 8,505,116, which is a continuation-in-part of application No. 13/588,035, filed on Aug. 17, 2012, now Pat. No. 8,752,308, which is a continuation of application No. 13/333,462, filed on Dec. 21, 2011, now Pat. No. 8,266,828.

(60) Provisional application No. 61/429,177, filed on Jan. 2, 2011, provisional application No. 61/528,100, filed on Aug. 26, 2011.

(51) Int. Cl.

| | |
|---|---|
| ***A42B 1/04*** | (2006.01) |
| ***A42B 1/20*** | (2006.01) |
| ***A41D 27/08*** | (2006.01) |
| ***A42B 1/00*** | (2006.01) |
| ***F15B 15/10*** | (2006.01) |

(52) U.S. Cl.

CPC ..... *A42B 1/004* (2013.01); *A42B 1/203* (2013.01); *A41D 27/08* (2013.01); *F15B 15/10* (2013.01); *Y10S 2/03* (2013.01); *Y10S 2/10* (2013.01)

USPC ..... 2/200.1; 2/DIG. 3; 2/DIG. 10

(58) Field of Classification Search

CPC ..... A42B 1/004; A42B 1/006; A42B 1/20; A42B 1/201; A42B 1/203

USPC ..... 2/DIG. 3, 200.1, DIG. 10, 421, 171; D2/865, 866, 869

See application file for complete search history.

(56) References Cited

U.S. PATENT DOCUMENTS

| | | | | | |
|---|---|---|---|---|---|
| 1,560,073 | A | * | 11/1925 | Bontempi et al. | 2/171.02 |
| 2,673,349 | A | * | 3/1954 | Key | 2/175.1 |
| 2,721,420 | A | | 10/1955 | Chatten | |
| 2,803,015 | A | * | 8/1957 | Milone | 2/171.03 |
| 3,047,879 | A | * | 8/1962 | Spreiregen | 2/181 |
| 3,125,827 | A | | 3/1964 | Ostrander | |

(Continued)

FOREIGN PATENT DOCUMENTS

| | | | |
|---|---|---|---|
| EP | 0524325 | A1 | 1/1993 |
| GB | 2437260 | A | 10/2007 |

(Continued)

*Primary Examiner* — Danny Worrell

(74) *Attorney, Agent, or Firm* — Patent Law Offices of Michael E. Woods; Michael E. Woods

(57) ABSTRACT

A system and method for increasing customer interest in head coverings. A set of actuating components are coupled to moveable elements of an active head covering, the moveable elements respond to operation of an actuating mechanism in a side extension.

25 Claims, 13 Drawing Sheets

(56) References Cited

U.S. PATENT DOCUMENTS

| | | | | | |
|---|---|---|---|---|---|
| 3,141,261 | A | | 7/1964 | Mirando | |
| 3,186,126 | A | | 6/1965 | Ostrander | |
| 3,237,344 | A | | 3/1966 | Ostrander | |
| 3,340,846 | A | | 9/1967 | Magiera | |
| 3,451,160 | A | | 6/1969 | Ryan et al. | |
| 3,501,144 | A | | 3/1970 | Schmidt | |
| 3,738,024 | A | | 6/1973 | Matsuda | |
| 3,740,893 | A | | 6/1973 | Shinoda | |
| 3,882,631 | A | | 5/1975 | Goldfarb et al. | |
| 4,009,528 | A | | 3/1977 | Villari, Jr. et al. | |
| 4,057,928 | A | | 11/1977 | Terzian | |
| 4,067,138 | A | | 1/1978 | Cederholm et al. | |
| 4,124,952 | A | | 11/1978 | Terzian | |
| 4,217,725 | A | | 8/1980 | Sapkus et al. | |
| 4,218,780 | A | * | 8/1980 | Growe et al. | 2/171 |
| 4,287,681 | A | | 9/1981 | Albert et al. | |
| 4,324,005 | A | * | 4/1982 | Willis | 2/413 |
| 4,669,997 | A | | 6/1987 | Kulesza et al. | |
| 4,759,737 | A | | 7/1988 | Ferenczi | |
| 4,828,526 | A | | 5/1989 | Schneider et al. | |
| 4,845,865 | A | | 7/1989 | Chang et al. | |
| D328,179 | S | * | 7/1992 | Barker | D2/883 |
| 5,129,106 | A | * | 7/1992 | Liou | 2/411 |
| D336,543 | S | * | 6/1993 | Murray et al. | D28/41 |
| 5,243,707 | A | * | 9/1993 | Bodinet | 2/200.1 |
| 5,257,470 | A | | 11/1993 | Auger et al. | |
| 5,259,070 | A | * | 11/1993 | De Roza | 2/413 |
| 5,285,585 | A | | 2/1994 | Baker | |
| 5,325,539 | A | * | 7/1994 | Kronenberger | 2/195.2 |
| 5,353,525 | A | | 10/1994 | Grim | |
| 5,391,106 | A | | 2/1995 | Lidert, Jr. | |
| 5,564,201 | A | | 10/1996 | O'Connell | |
| D410,318 | S | * | 6/1999 | Chen | D2/869 |
| 6,094,742 | A | * | 8/2000 | Gattamorta | 2/12 |
| 6,389,604 | B1 | * | 5/2002 | Day | 2/200.1 |
| 6,439,950 | B1 | | 8/2002 | Goldman et al. | |
| 6,609,942 | B1 | | 8/2003 | Cole et al. | |
| 6,672,932 | B1 | | 1/2004 | Panec et al. | |
| 6,681,504 | B2 | | 1/2004 | Kinan | |
| 6,881,119 | B2 | | 4/2005 | Panec et al. | |
| 6,889,451 | B2 | | 5/2005 | Passke et al. | |
| 7,451,555 | B1 | | 11/2008 | Lakic | |
| 8,105,129 | B2 | * | 1/2012 | Chen | 450/38 |
| 8,327,462 | B2 | * | 12/2012 | Feldman et al. | 2/2.5 |
| 8,505,116 | B2 | | 8/2013 | Strong | |
| 2003/0135914 | A1 | * | 7/2003 | Racine et al. | 2/413 |
| 2004/0003452 | A1 | * | 1/2004 | Schiebl | 2/421 |
| 2004/0226078 | A1 | * | 11/2004 | Lahman et al. | 2/413 |
| 2010/0219221 | A1 | | 9/2010 | Zheng | |

FOREIGN PATENT DOCUMENTS

| | | | |
|---|---|---|---|
| KR | 1020040039214 | A | 5/2004 |
| KR | 2020100005134 | U | 5/2010 |
| KR | 2020110008364 | U | 8/2011 |
| WO | 2007025353 | A1 | 3/2007 |
| WO | 2012092152 | A2 | 7/2012 |

* cited by examiner

ACTIVE HEAD COVERING WITH MOVEABLE ELEMENT

CROSS REFERENCE TO RELATED APPLICATIONS

This application is a continuation-in-part of U.S. patent application Ser. No. 13/772,316 which is a continuation-in-part of U.S. patent application Ser. No. 13/588,035, which is a continuation of U.S. patent application Ser. No. 13/333,462 which claims benefit of both U.S. Provisional Application No. 61/429,177, filed 2 Jan. 2011, and U.S. Provisional Application No. 61/528,100, filed 26 Aug. 2011, the contents of these applications in their entireties are expressly incorporated by reference thereto for all purposes.

FIELD OF THE INVENTION

The present invention relates generally to headwear, and more specifically, but not exclusively, to head coverings having user-controlled moveable elements.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

There are many types of hats, caps, and other types head coverings that are worn for protection against elements, for ceremonial or religious reasons, for safety reasons, or for fashion, among other reasons. Retailers continue to search for changes in head coverings to increase customer interest.

What is needed is a system and method for increasing customer interest in head coverings.

BRIEF SUMMARY OF THE INVENTION

Disclosed is a system and method for increasing customer interest in head coverings. The following summary of the invention is provided to facilitate an understanding of some of technical features related to active head coverings with one or more moveable element, and is not intended to be a full description of the present invention. A full appreciation of the various aspects of the invention can be gained by taking the entire specification, claims, drawings, and abstract as a whole. The present invention is applicable to other styles of hats besides head coverings with side extension, to other types clothing, and to other types and methodologies of actuating mechanisms.

An active head covering, including a head portion having an outside layer, an inside layer coupled to the outside layer, and a head cavity defined therebetween, the outside layer defining at least one aperture, a first lateral portion and a second lateral portion opposite of the first lateral portion; a side extension portion extending downwardly from one of the lateral portions, the side extension portion defining a side extension cavity communicated to the head cavity and a terminal portion having a terminal portion cavity; and an actuator assembly, including: a first actuating mechanism disposed within the terminal portion, the first actuating mechanism having a bulb defining a first actuating volume containing a first quantity of air, the bulb repeatably collapsible to expel a portion of the first quantity of air through a first actuating port of the bulb, the bulb automatically expanding to refill the first actuating volume; a first remote actuator having a pair of flexible layers sealed to form a non-deformable actuating balloon defining a second actuating volume accessible through a second actuating port, the first remote actuator having a fixed portion foldably coupled to a moving portion at a fold region with the moving portion at least partially overlapping the fixed portion defining a folded configuration, the fixed portion disposed inside the head cavity with the fold region and the moving portion both disposed outside of the cavity portion, the first remote actuator unfolding about the fold region from the folded configuration in response to air entering into the second actuating volume with the moving portion moving away from the fixed portion and the first remote actuator folding about the fold region in response to air exiting from the second actuating volume, the first remote actuator biased to the folded configuration; and an air communication channel disposed within the terminal portion cavity and the head cavity and coupled to the first actuating port of the first actuating mechanism and to the second actuating port of the first remote actuator.

An active head covering, including a head portion having an outside layer with an inside surface configured to be proximate a wearer's head and an outside surface, the outside layer defining at least one aperture; and an actuator assembly, including: a first actuating mechanism having a collapsible structure defining a first actuating volume containing a first quantity of air, the collapsible structure repeatably collapsible to expel a portion of the first quantity of air through a first actuating port of the collapsible structure, the collapsible structure automatically expanding to refill the first actuating volume; a first remote actuator having a pair of flexible layers sealed to form an actuating balloon defining a second actuating volume accessible through a second actuating port configured to repeatably inflate and deflate the actuating balloon, the first remote actuator having a first portion coupled to a second portion defining an unactuated configuration when the actuating balloon is deflated and defining an actuated configuration when the actuating balloon is inflated, the first portion fixed to the inside surface with the second portion disposed through the aperture at a location outside of the head portion, the first remote actuator transitioning from the unactuated configuration to the actuated configuration in response to air entering into the second actuating volume and the first remote actuator transitioning from the actuated configuration to the unactuated configuration in response to air exiting from the second actuating volume, the first remote actuator biased to the unactuated configuration; and an air communication channel coupled to the first actuating port of the first actuating mechanism and to the second actuating port of the first remote actuator.

An active head covering, including a head portion having an outside layer defining a head cavity therewithin; and an actuator assembly coupled to the head portion, the actuator assembly including: a first actuating mechanism, the first actuating mechanism having a bulb defining a first actuating volume containing a first quantity of air, the bulb repeatably collapsible to expel a portion of the first quantity of air through a first actuating port of the bulb, the bulb automatically expanding to refill the first actuating volume; a first remote actuator forming an actuating balloon defining a second actuating volume accessible through a second actuating port, the first remote actuator having a fixed portion foldably coupled to a moving portion at a fold region with the moving portion at least partially overlapping the fixed portion defining a folded configuration, the fixed portion coupled to the outer layer with the fold region and the moving portion both disposed outside of the head cavity portion, the first remote actuator unfolding about the fold region from the folded configuration in response to the portion of the first quantity of air expelled from the first actuating port with the moving portion moving away from the fixed portion and the first remote actuator folding about the fold region in response to air exiting from the second actuating volume, the first remote actuator biased to the folded configuration; and an air communication channel coupled to the first actuating port of the first actuating mechanism and coupled to the second actuating port of the first remote actuator.

An active head covering, including a visor portion having a front portion and a securing system coupled to said front portion configured to secure said visor portion to a head of a wearer, said visor portion and said securing system defining a head cavity therewithin; and an actuator assembly coupled to said visor portion, said actuator assembly including: a first actuating mechanism, said first actuating mechanism having a bulb defining a first actuating volume containing a first quantity of air, said bulb repeatably collapsible to expel a portion of said first quantity of air through a first actuating port of said bulb, said bulb automatically expanding to refill said first actuating volume; a first remote actuator forming an actuating balloon defining a second actuating volume accessible through a second actuating port, said first remote actuator having a fixed portion foldably coupled to a moving portion at a fold region with said moving portion at least partially overlapping said fixed portion defining a folded configuration, said fixed portion coupled to said outer layer with said fold region and said moving portion both disposed outside of said head cavity portion, said first remote actuator unfolding about said fold region from said folded configuration in response to said portion of said first quantity of air expelled from said first actuating port with said moving portion moving away from said fixed portion and said first remote actuator folding about said fold region in response to air exiting from said second actuating volume, said first remote actuator biased to said folded configuration; and an air communication channel coupled to said first actuating port of said first actuating mechanism and coupled to said second actuating port of said first remote actuator.

A method for operating an active head covering, includes a) placing a head portion of the active head covering over a head of a wearer with a side extension coupled to the head portion including a terminal portion configured to extend at least to a shoulder of the wearer, the head portion having an outside layer with an inside surface and an outside surface with the inside surface configured to be proximate the head and with the outside layer defining at least one aperture; b) collapsing a collapsible structure coupled to the terminal portion to expel a quantity of air from a first actuating volume of the collapsible structure through a first actuating port; c) communicating an increased air pressure, responsive to the quantity of air expelled from the first actuating volume, to a remote actuator coupled to the head portion, the remote actuator having a pair of flexible layers sealed to form a non-deformable actuating balloon defining a second actuating volume accessible through a second actuating port, the remote actuator having a fixed portion foldably coupled to a moving portion at a fold region with the moving portion at least partially overlapping the fixed portion defining a folded configuration, the fixed portion fixed to the inside surface with the fold region and the moving portion both disposed outside of the head portion through the aperture, the remote actuator unfolding about the fold region from the folded configuration in response to air entering into the second actuating volume responsive to the increased air pressure with the moving portion moving away from the fixed portion and the first remote actuator folding about the fold region in response to air exiting from the second actuating volume, the remote actuator biased to the folded configuration; d) moving, responsive to the increased air pressure, a sheath to an operated configuration, the sheath coupled to the outside surface proximate the aperture wherein the sheath conceals the fold region and the moving portion of the remote actuator extending through the aperture with the sheath coupled to the moving portion and having the operated configuration when the remote actuator is unfolded; and e) moving the sheath to an unoperated configuration irrespective of whether the collapsible structure is released by transitioning the remote actuator to the folded configuration by an exiting of air from the second actuating volume, the sheath having the unoperated configuration when the remote actuator is folded wherein the exiting of air includes an exit through a bleed mechanism communicated to the second actuating volume and may additionally include an exit of air by releasing the collapsible structure allowing the collapsible structure to automatically expand and refill the first actuating volume.

An active head covering includes a head portion having an outside layer defining a head cavity therewithin; and an actuator assembly coupled to said head portion, said actuator assembly including: a first actuating mechanism, said first actuating mechanism having a bulb defining a first actuating volume containing a first quantity of air, said bulb repeatably collapsible to expel a portion of said first quantity of air through a first actuating port of said bulb, said bulb automatically expanding to refill said first actuating volume; a first remote actuator forming an actuating balloon defining a second actuating volume accessible through a second actuating port, said first remote actuator having a fixed portion foldably coupled to a moving portion at a fold region with said moving portion at least partially overlapping said fixed portion defining a folded configuration, said fixed portion coupled to said outer layer with said fold region and said moving portion both disposed outside of said head cavity portion, said first remote actuator unfolding about said fold region from said folded configuration in response to said portion of said first quantity of air expelled from said first actuating port with said moving portion moving away from said fixed portion and said first remote actuator folding about said fold region in response to air exiting from said second actuating volume, said first remote actuator biased to said folded configuration; and an air communication channel coupled to said first actuating port of said first actuating mechanism and coupled to said second actuating port of said first remote actuator.

A method for operating an active head covering worn over a head of a wearer, includes a) placing a head portion of the active head covering the head, said head portion having an outside layer with an inside surface and an outside surface with said inside surface configured to be proximate the head; b) collapsing a collapsible structure coupled to said head portion to expel a quantity of air from a first actuating volume of said collapsible structure through a first actuating port; c) communicating an increased air pressure, responsive to said quantity of air expelled from said first actuating volume, to a remote actuator coupled to said head portion, said remote actuator having an actuating balloon defining a second actuating volume accessible through a second actuating port, said remote actuator having a fixed portion foldably coupled to a moving portion at a fold region with said moving portion at least partially overlapping said fixed portion defining a folded configuration, said fixed portion coupled to said outer layer with said fold region and said moving portion both disposed outside of said head portion, said remote actuator unfolding about said fold region from said folded configuration responsive to said increased air pressure with said moving portion moving away from said fixed portion and said first remote actuator folding about said fold region in response to air exiting from said second actuating volume, said remote actuator biased to said folded configuration; d) moving, responsive to said increased air pressure, a sheath to an operated configuration, said sheath coupled to said outside surface proximate said aperture wherein said sheath conceals said fold region and said moving portion of said remote actuator with said sheath coupled to said moving portion and having said operated configuration when said remote actuator is unfolded; and e) moving said sheath to an unoperated configuration irrespective of whether said collapsible structure is released by transitioning said remote actuator to said folded configuration by an exiting of air from said second actuating volume, said sheath having said unoperated configuration when said remote actuator is folded wherein said exiting of air includes an exit through a bleed mechanism communicated to said second actuating volume and may additionally include an exit of air by releasing said collapsible structure allowing said collapsible structure to automatically expand and refill said first actuating volume.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 7 illustrates the alternative active head covering in an unactuated state;

FIG. 8 illustrates the alternative active head covering in an actuated state;

FIG. 10 illustrates the valve allowing air into an air reservoir;

FIG. 11 illustrates the valve with the bleed mechanism bleeding air from the air reservoir;

DETAILED DESCRIPTION OF THE INVENTION

Embodiments of the present invention provide a system and method for increasing customer interest in head coverings. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

U.S. Pat. No. 8,266,828 for Footwear Having Air-controlled Active Elements describes a clothing article for a foot in which active elements associated with the clothing article were automatically activated as the user walked. This patent is hereby expressly incorporated by reference thereto in its entirety for all purposes.

In the following discussion and in the figures, a modification to a particular style of head covering is shown, however it is understood that the present invention may be adapted to other styles of head covering. A critter cap depicts a particular animal, hence its name. There is a portion worn on the head that includes static animal features and a thematic likeness of the depicted animal. There are typically extended ear guards that may terminate in a representation of a limb of the depicted animal. Embodiments of the present invention include structures and methods that animate one or more features of such a hat under a user's control.

Figure 1:
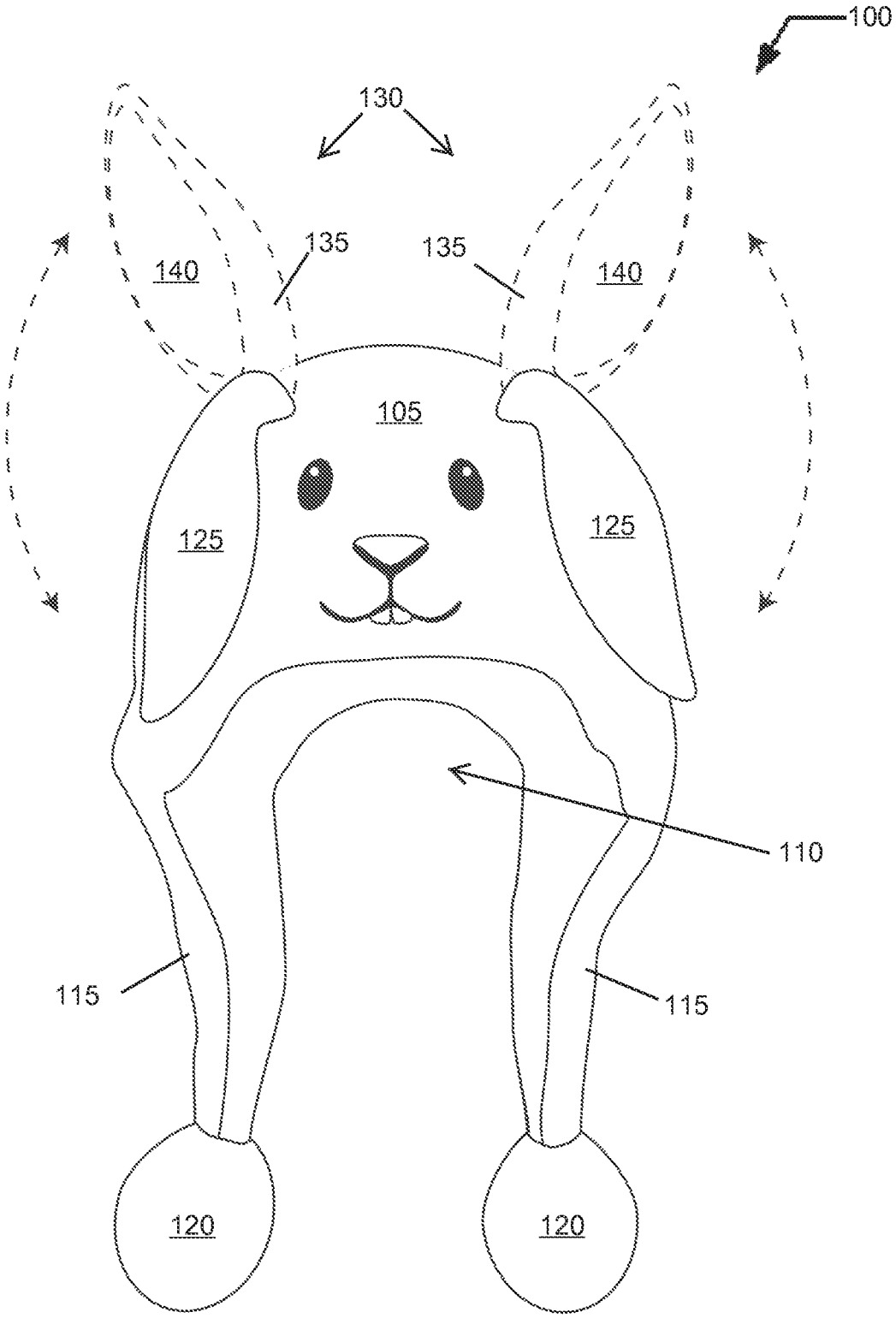
FIG. 1 illustrates a front elevation view of an active head covering having one or more moveable elements arranged into a thematic configuration.

FIG. 1 illustrates a front elevation view of an active head covering 100 having one or more moveable elements arranged into a thematic configuration, in this case, a rabbit. Active head covering 100 includes a head portion 105 that is designed to fit over a top, a side and a back of a head of a user (and sometimes the back of a neck of the user as well). A face of the user is uncovered (though most of a forehead is covered) with the eyes, nose, and mouth revealed through a front opening 110. Active head covering 100 includes a side extension 115 on one or both lateral sides of the head. Side extension 115 covers an ear and a side of the neck of the user and often extends past a shoulder height to hang in front of the user's chest. Side extension 115 includes a terminal portion 120 that is at a lowest level and is positioned within easy reach of the wearer. A length of side extension 115 is variable and may position terminal portion 120 anywhere from a location at or near the shoulder to a location at or near the elbow or hand of the user while wearing active head covering 100. One or more moveable elements 125 are attached to head portion 105 and are independently or concurrently operated by one or more manually-operated actuators (not shown) disposed within one or more terminal portions 120.

Active head covering 100 may be designed for children or adults and the length of side extension may be adapted accordingly; therefore a length of side extension 115 for most implementations will be in a range of 2-3 inches on the short end of the range to 2-3 feet on the long end of the range.

Head portion 105 is constructed of at least two layers, an outside shell and an inside liner. The material may be natural or synthetic fabric of virtually any type with the disclosed embodiments including one or more outer/visible components being of plush construction. Plush, in this context refers to natural (e.g., mohair, worsted yarn, silk) or synthetic (e.g., polyester) fibers and may include a filler or "stuffing" between the outside shell and the inside liner. One configuration includes the outside shell having acrylic knit material and the inside liner (stitched to the outside shell) including fleece. In this implementation, head portion 105 is "stretchable" and allows for a "one size" fits all implementation, which means that it is form-fitting in most cases. In some implementations, the inside layer does not completely match the inside of head portion 105 leaving some of the inside uncovered. Other implementations may dispense with the inside layer completely. Such implementations may not conceal some or all of the actuating components, or the actuating components may be integrated or concealed in some other fashion, such as integrating air channels inside the outside layer.

As described herein, active head covering 100 includes one or more user-controlled moveable elements. There is a wide range of different sizes and weights associated with these moveable elements. In some implementations, it may be desirable for head portion 105 to be securely associated with the head to achieve desired results and effects associated with moving these elements. In some embodiments, head portion includes an elastomer yarn or thread and is designed to fit snug on the head. In some embodiments, a strap or the like may be used to help secure head portion 105 in place.

Side extensions 115 of the disclosed embodiments also include a multilayer construction and may be constructed of the same material as used in head portion 105. In the preferred embodiments a thematic configuration is often set for active head covering 100, such as a particular animal, fanciful creature, or the like. The moveable elements are configured to further support and extend the theme, such as by providing moving limbs and the like. Side extensions 115 may also extend the theme by also providing theme-specific visualizations and arrangements. For example, it/they may depict a leg of the animal or creature.

Terminal portions 120 may also be configured to participate in the theme of active head covering 100. When side extension 115 simulates an appendage of the animal or creature, terminal portion 120 may simulate a hand, paw, foot, hoof, fin, or the like. In the disclosed embodiments, terminal portion 120 has a greater lateral width than side extension 115 because it hides an actuating mechanism used to manipulate the one or more moveable elements 125. As further detailed herein, because of a natural symmetry it is common to provide a pair of side extensions 115, each including a terminal portion 120. The disclosed embodiments include one or two moveable elements and one or two actuating mechanisms hidden in terminal portions 120. Some implementations provide that two moveable elements may be independently controlled by two actuating mechanisms while other implementations include the two moveable elements controlled concurrently by the same single actuating mechanism. This principle may be extended to more than two moveable elements with a first set controlled by a first actuating mechanism and a second set controlled by a second actuating mechanism. The disclosed embodiments provide for a maximum of two actuating mechanisms, one on each lateral side of the wearer's body.

Moveable elements 125 are external thematic elements that respond to the actuating mechanisms to tilt, lift, unfold, expand, extend, rotate, flap, open, or otherwise move to a first configuration when one or more actuating mechanisms are operated. Moveable elements 125 are biased to an untilted, dropped, folded, contracted, withdrawn, unrotated, closed, or otherwise motionless second configuration. Manual operation of actuating mechanism in terminal portion 120 overcomes the bias to transition an effected moveable element from the second configuration to the first configuration. As further explained herein, moveable element 125, being biased to the second configuration, automatically transitions from the first configuration to the second configuration after a period.

Moveable elements 125 contain concealed actuators that are covered by material (e.g., cloth, plush, other fabric, plastic, rubber, and the like) that may be opaque, translucent, transparent or a combination of these properties. Some moveable elements 125 include a first portion that is visible in both the first configuration and in the second configuration and a second portion only visible in the first configuration. For example, in FIG. 1, active head covering 100 includes a rabbit theme and moveable elements 125 are shown in the second configuration as rabbit ears. When actuated, moveable elements 125 are lifted to the first configuration including a lifted set of rabbit ears 130. Lifted set of rabbit ears 130 includes an outside ear portion 135 as the first portion and an inside ear portion 140 as the second portion. As shown, in the first configuration, outside ear portion 135 is visible in both the first configuration and in the second configuration. Inside ear portion 140 is visible in the first configuration only.

Moveable elements 125 of FIG. 1 are configured to lift laterally, but are not required to do so. A relative motion between moveable element 125 and head portion 105 is determined by the type of internal actuator included within moveable element 125 and the arrangement and specifics of an attachment configuration of moveable element to head portion 105, including any hinging coupling that physically connects moveable element 125 to head portion 105. Some moveable elements 125 may move laterally, frontally, rearwardly, side-to-side, bottom-to-top, diagonally, or a combination thereof. In some instances, the concealed actuator within moveable element 125 may have a complex motion.

Figure 2:
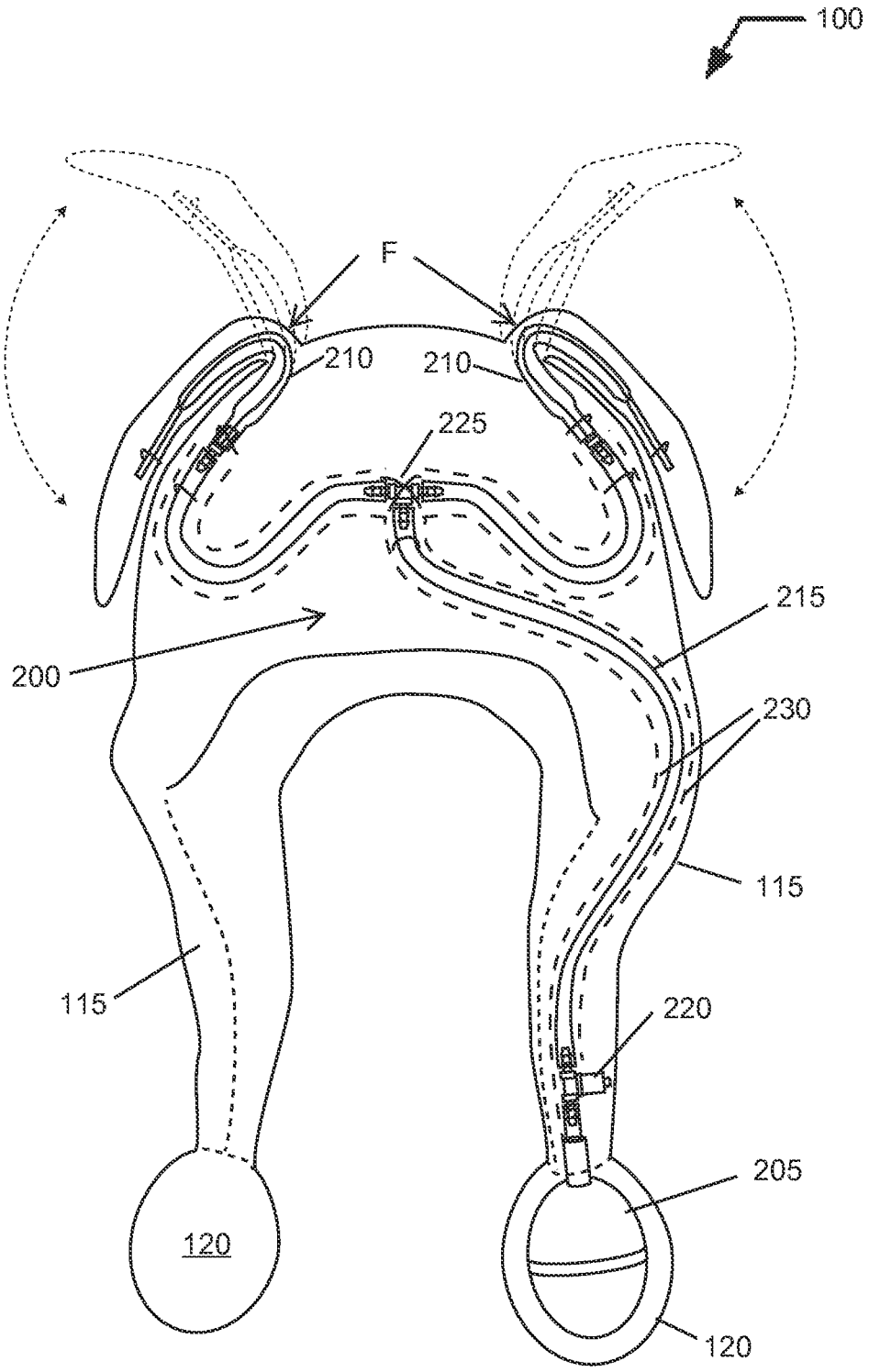
FIG. 2 illustrates a schematic view of actuating components of the active head covering illustrated in FIG. 1.

FIG. 2 illustrates a schematic view of a set of actuating components 200 of active head covering 100 illustrated in FIG. 1. Actuating components 200 of the embodiment illustrated in FIG. 2 are concealed within the multilayers of active head covering 100 with a portion of an exterior layer removed to reveal an arrangement of actuating components 200. This arrangement is only representative as there are many different component organizations that are possible to achieve the purpose and effect demonstrated by the depicted arrangement. The arrangement illustrated in FIG. 2 provides a type of single actuating mechanism controlling concurrently multiple moveable elements 125.

Actuating components 200 include an actuating mechanism 205, one or more remote actuators 210, a conduit 215 communicating air from actuating mechanism 205 to the one or more remote actuators 210, and an intake valve assembly 220 disposed in conduit 215. In the disclosed embodiment, actuating components 200 may be formed as a discrete separate assembly that may be installed (e.g., cut and sewn) into active head covering 100. In other implementations, actuating components 200 may be independent elements separately installed and assembled into active head covering 100.

The incorporated patent application includes a discussion of actuating components used in footwear. Actuating components 200 are adapted from those components to meet the special needs and requirements of the present invention. When adapting the footwear actuating components in the headwear context, there is no easy way to implement automatic actuation as was done in the footwear example which had the actuating mechanism disposed within the sole. Each step resulted in operation of the actuating mechanism which triggered moveable elements affixed to an upper of the footwear. Being disposed within a sole of child's shoe or the like imposed a number of design constraints including a relatively low capacity actuating mechanism and concerns regarding overpressure. The low capacity actuating mechanism required efficient small sized remote actuators and the potential overpressure results in sturdier construction and structures referred to as bleed valves. In the disclosed embodiments, the system is configured for some robustness as it allows for unintended perforations or injury to the air channels and actuating volumes to function as secondary bleed mechanisms. Thus the illustrated systems are considered open, lossy, and the like as opposed to sealed/closed systems.

Similar design constraints include efficient manufacturability and low cost of goods. Simple and non-complex is preferred over complicated and complex structures, assemblies, and arrangements. The disclosed embodiments detail a specific combination of actuating components that provides efficient repeatable motion to the moveable elements at a cost that results in a price point supported by the market for active head coverings.

Actuating mechanism 205 is similar in construction and operation to the corresponding structure in the incorporated applications. That is, actuating mechanism 205 includes a resilient bulb or bellows that contains an actuating air volume. The bulb is repeatably collapsible to expel a portion of the actuating air volume through an actuating port with each actuation. The bulb is configured to be collapsed by the user squeezing the bulb with a hand. Releasing the bulb allows the bulb to automatically expand and refill the actuating air volume with air. The air is refilled with ambient air, such as through a one-way valve disposed within the bulb and/or through intake valve assembly 220. When implemented for children, the bulb is made very pliable to be easily squeezed and operated by a young child.

One risk associated with the footwear implementation that is reduced in the embodiments described herein is that of rupture. An active footwear article that is operated by a bellows disposed in the sole is subject to potentially large impulses that can create significant overpressure stresses on the actuating assembly. These impulses may be easily produced, such as by jumping and landing on the soles of the footwear. Actuating components 200 are not as much at risk because it is more challenging for a user to generate similar impulses by squeezing the bulb.

Preferably the bulb is made from a blown plastic configured to contain a sufficient quantity of air to operate remote actuators 210, while being sufficiently pliable and robust to be repeatably squeezed and released without degradation of actuating mechanism's ability to expel the portion of air each time it is squeezed and refill when released.

Remote actuator 210 may be implemented in many different ways. The incorporated patent applications detail several different styles and types of remote actuators, any of which may be adapted for remote actuator 210. The disclosed embodiments include remote actuator 210 that includes an elongate resilient outer shell that contains an actuating volume accessed through an actuating port. Remote actuator 210 is controlled (e.g., unfolding and folding) by air entering into and leaving the actuating volume.

Remote actuator 210 includes a folded configuration in which one portion overlies another portion when the actuating volume has little if any air, the amount of folding is greatest with the least amount of air within the actuating volume. Air entering into the actuating volume causes remote actuator 210 to unfold and straighten. A quantity of air entering into the actuating volume controls the degree and extent of the unfolding. Remote actuator 210 is unfolded to the greatest degree when the actuating volume contains the greatest quantity of air. In some implementations, remote actuator 210 may be fully unfolded when fully actuated. The actuating air volume of actuating mechanism 205 is sized to achieve the desired degree of unfolding of remote actuator 210, it being understood that some embodiments do not desire or require that remote actuator 210 fully unfold.

Remote actuator 210 is biased towards the fully folded configuration. Air entering into the actuating volume is calibrated to cause remote actuator 210 to unfold against the biasing force. Periodically the air pressure at the actuating port will drop below that which is sufficient to overcome the biasing force and remote actuator will then automatically fold and dispel all or a portion of air from the actuating volume to enable it to fold. The degree of folding is at least partially influenced by the air pressure at the actuating port resisting the dispelling of the air from the actuating volume.

In some embodiments, as noted above and as described in the incorporated patent applications, it may be desirable or required to include an optional bleed valve or the like in the actuating volume. For example, the bleed valve may be included at an extreme distal end when the proximal end includes the actuating port and a fold region F is intermediate the two ends. In this configuration, air entering into the actuating volume first unfolds remote actuator and as long as a rate of air entering into the actuating volume is greater than a rate of air exiting the bleed valve, remote actuator will continue to unfold. When air stops entering into the actuating volume, the air exiting the bleed valve will then allow remote actuator to automatically fold in response to the biasing forces.

As noted in the incorporated patent applications, there are several different ways of providing the biasing force to remote actuator 210. A biasing mechanism provides the biasing force and may include a memory plastic that "memorizes" a desired folded shape, a metal spring with a restorative spring constant, a memory alloy with a preconfigured shape, or the like is preformed into a biasing configuration to position remote actuator into the folded configuration and attached to or integrated with remote actuator 210. Unfolding remote actuator 210 operates against the biasing mechanism which will begin to automatically fold remote actuator 210 once the air pressure within the actuating volume drops low enough. As illustrated in the embodiments of FIG. 1-FIG. 4 and FIG. 6-FIG. 8, the biasing force may be supplemented by gravity to help fold/close the remote actuators.

In FIG. 2, the outer shell of remote actuator 210 is formed from a memory plastic that may be set (e.g., thermoset) into a biasing configuration. For example, remote actuator 210 includes a blow-molded shell of "memory" plastic having the internal cavity. The shell is initially formed into the unfolded configuration and then the shell is folded/bent into the folded configuration and then set so that the folded configuration is memorized. Thereafter, air entering into the folded shell will unfold it. Once the air pressure falls, the biasing forces from the outer shell will re-fold the actuator and will be ready for re-actuation. The cycle of unfolding and folding is repeatable. One advantage of this construction is that the outer shell forming the actuating volume may be made thin and pliable while a portion forming the actuating port may be more rigid and suitable for forming a conduit connector integrated into the manufacturing process and reducing costs of assembly.

In the footwear, in some embodiments it was important for responsiveness that a remote actuator automatically deflate after a period even when a user did not unweight the sole in preparation for another air-expelling weighting of the sole. In the present invention, because the remote actuators are manually operated, it is an implementation option to reproduce this behavior (e.g., to deactuate remote actuators 210 while actuating mechanism 205 remains actuated) or to maintain remote actuator 210 in the actuated configuration as long as the actuating mechanism remains actuated).

Conduit 215 includes air tubes and the like that are able to communicate air from actuating mechanism 205 to one or more remote actuators 210. In the disclosed embodiments, conduit 215 is non-expandable at the air pressures employed to actuate remote actuators 210. Thus in this context, conduit 215 is non-expandable. In the illustrated embodiments, conduit 215 includes an actuating mechanism end and one or more remote actuator ends. The actuating mechanism end is coupled to actuating mechanism 205 and the remote actuator ends are coupled to the actuating ports of remote actuator 210.

There are several different arrangements included in the illustrated embodiments. Illustrated in FIG. 2 is an arrangement in which a single actuating mechanism 205 operates a pair of remote actuators 210. One way this is accomplished is by use of a conduit multiplier 225 (e.g., a "three-way" connector) that splits a single channel of conduit 215 into two or more channels. Other arrangements include a pair of actuating mechanisms operating either one or a pair of remote actuators. And as noted, the present invention includes implementations having more than two actuating mechanisms and/or more than two remote actuators. In implementations including a single actuating mechanism in one terminal portion 120, a terminal portion 120 of the "other" side extension 115 not including the actuating mechanism is provided with a counterweight (e.g., beads or the like) to help balance active head covering 100 for the wearer.

For a pair of actuating mechanisms and a single remote actuator, conduit multiplier 225 would still be used to join channels from each actuating mechanism to a single channel coupled to the remote actuator. In this arrangement, either actuating mechanism controls operation of the remote actuator. In this sense, such an arrangement is an ambidextrous arrangement. Ambidextrous in the sense that the user is able to use either hand (easily associated with a nearest terminal portion 120, both having an actuating mechanism) to achieve the same result.

For a pair of actuating mechanisms and pair of remote actuators, it is possible that the remote actuators are controlled independently from each other or controlled concurrently with each other. In an independent implementation, two conduits 215 are used, one conduit 215 extending from one actuating mechanism to the remote actuator it controls. In operation, one actuating mechanism controls one remote actuator and the other actuating mechanism controls the other remote actuator. In a concurrent implementation, a four-way conduit multiplier is used to co-join the two channels from the actuating mechanisms to the two channels from the remote actuators. In operation, either actuating mechanism actuates both remote actuators at the same time; another ambidextrous arrangement.

Intake valve assembly 220 is disclosed in the parent applications as a special three-way connector. It is special in that two-way airflow is unobstructed between a first port and a second port while airflow is one-way from a third port to the first port and the second port. In other words, when coupling the third port of intake valve assembly 220 to ambient, air may flow from ambient to the first port and/or the second port but air will not flow out to ambient from the third port. The first port and the second port are coupled to conduit 215 so that two-way air flow exists in the channel from an actuating mechanism to the one or more remote actuators.

A consideration for active head covering 100 is that it is designed for being worn on the head, with the head including environmental sensors like the ears, nose, and mouth. The arrangement and configuration of the elements of actuating components 200 are preferably positioned to minimize any adverse user reaction to operation of actuating components 200. For example, intake valve assembly 220 can generate an airflow sound (e.g., a hissing or the like) that some users may find objectionable. This can particularly be the case when intake valve assembly 220 is located immediately adjacent one or both ears. In FIG. 2, intake valve assembly 220 is shown located immediately adjacent actuating mechanism 205. The actuating port of actuating mechanism 205 is directly coupled to the first port of intake valve assembly 220 and the second port of intake valve assembly 220 is coupled to conduit 215. This is one way to reduce costs and simplify construction to eliminate any additional portion of conduit 215 that may extend between actuating mechanism 205 and intake valve assembly 220. This has the attendant benefit of locating intake valve assembly 220 farthest down within side extension 115 and therefore located at the greatest distance from the ears of the users. This location also enhances safety in that intake valve assembly 220 will generally be constructed of rigid plastic which could injure a child if it were positioned in head portion 105 and then the area near the intake valve assembly struck with another object. Further to enhancing safety, preferred embodiments include a softer, pliable, flexible-walled conduit 215 as some plastic tubing may include hard/rigid walls that are less desirable for a head-worn product. The preferred embodiments also use a softer material in the construction of remote actuators not only for the enhanced safety, but because they may be made to be more easily actuated for operation by children.

In FIG. 2, remote actuators 210 are configured so that an outside portion is disposed outside the outer layer of head portion 105 and an inside portion is disposed between the multilayers of head portion 105. An aperture is made in the outer layer of head portion 105 and the distal end of remote actuator 210 is passed through. Fold portion is located at the aperture but slightly outside the outer layer of head portion 105. A sheath is made for remote actuator 210 and attached to head portion 105 at the aperture to completely hide remote actuator 210. As discussed herein, the sheath includes two portions, a first portion and a second portion, in the sense of visibility based upon a state of remote actuator. The sheath is preferably designed so that the first portion and the second portion are differently designed, providing some contrast, and attendant surprise and increased interest, when the second portion is selectively revealed upon actuation. These portions of the sheath correspond in some implementations to outside ear portion 135 and inside ear portion 140 illustrated in FIG. 1.

When operating an actuating mechanism 205, air dispelled from the actuating air volume through the actuating port increases an air pressure of air within conduit 215 and increases the air pressure at the actuating ports of the remote actuators 210 that are coupled to the operated actuating mechanism 205. When the air pressure at the actuating port of the remote actuator(s) 210 is great enough to overcome the biasing force, air enters into the actuating volume and unfolds it against the biasing force. To an observer of the rabbit themed active head covering 100 illustrated in FIG. 1, squeezing terminal portion 120 corresponding to the operated actuating mechanism 205, both of the rabbit ears lift and reveal inside ear portions 140. When the user stops squeezing the corresponding terminal portion 120, actuating mechanism 205 is released and the bulb is refilled with air from ambient, conduit 215, and from the actuating volume of remote actuator 210 corresponding to the lifted rabbit ears. Consequently the rabbit ears fall until only outside ear portions 135 are visible. For a dual arrangement of actuating mechanisms 205, it would be possible to independently control the ears such that squeezing a left-hand side terminal portion raises a left-hand side rabbit ear only and squeezing a right-hand side terminal portion raises a right-hand side rabbit ear only.

Illustrated in FIG. 2 is a guiding/anchoring channel 230 (e.g., the dashed lines lateral conduit 215) that is stitched into the inside layer (or in some cases to the outside layer or to an intermediate layer) to help resist any undesired repositioning of the actuating components within active head covering 100. Of particular importance is anchoring in the attachment points where conduit 215 engages the actuating ports of remote actuators 210. Without proper definition of these anchors, remote actuators 210 may shift or bind within the sheath/head portion and interfere with unfolding and folding. It is preferred that the fold region F be located outside the outer layer of head portion 105 to reduce any binding/unfolding limitation.

Further, anchoring channel 230 and the attachment of a proximal end remote actuator 210 (e.g., the end of remote actuator with the actuating port) inside of the outside layer helps define the relative motion of remote actuator 210 and head portion 105. Without proper anchoring and without proper orientation, a remote actuator that is intended to move moveable elements in a first direction (up/down laterally) may fail to move them or may move them up/down towards the front of the head covering which may not match the intended theme and thus be unacceptable to the wearer.

Figure 3:
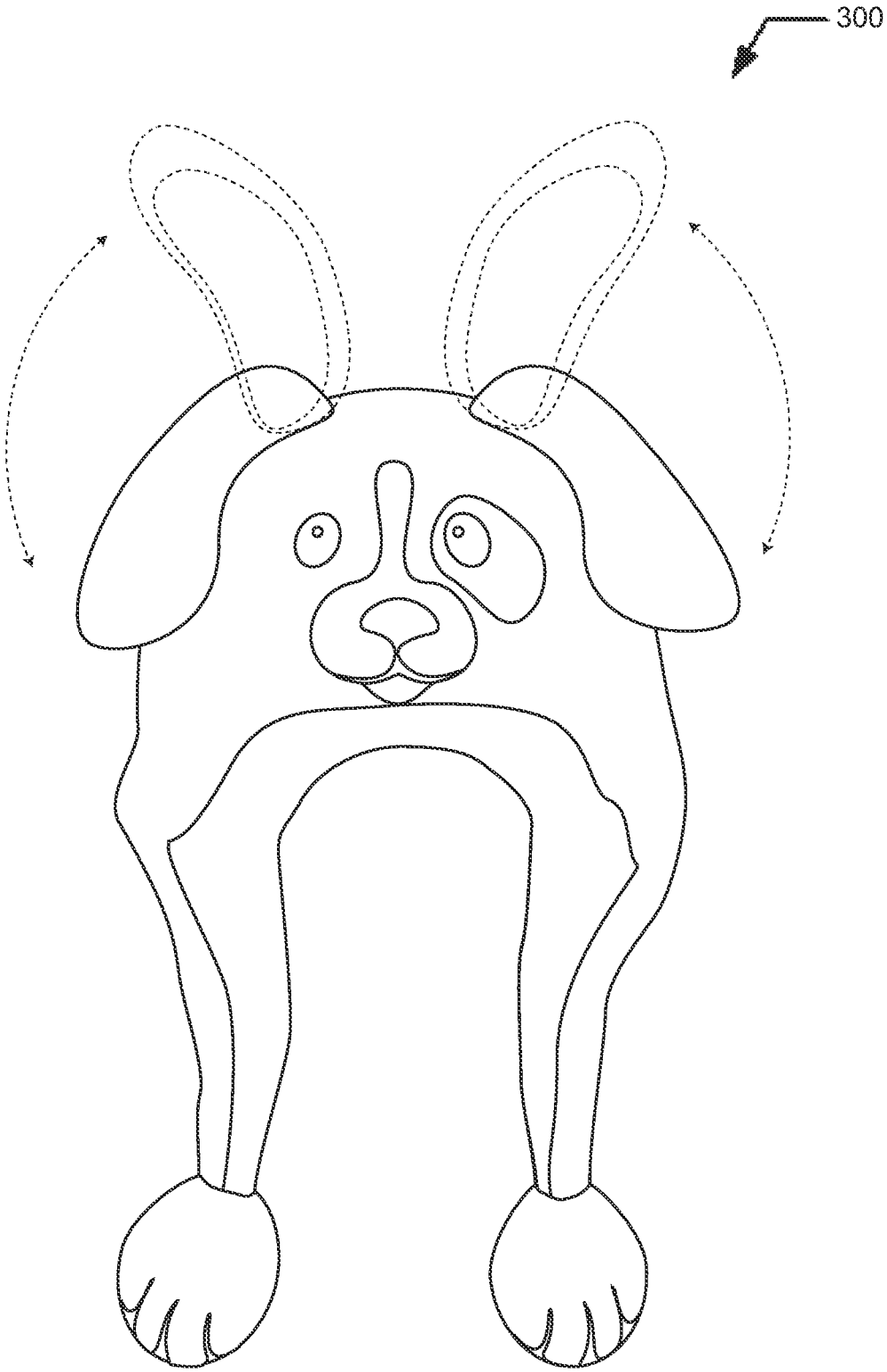
FIG. 3 illustrates an alternative active head covering including a first alternative thematic configuration.

FIG. 3 illustrates an alternative active head covering 300 including a first alternative thematic configuration. Active head covering 300 includes a dog theme with a pair of moveable elements configured as dog ears. The terminal portions include dog paws. Active head covering 300 supports both a single actuating mechanism and a dual actuating mechanism arrangement for control of the dog ears in response to operation of actuating mechanisms deployed within one or both of the terminal portions. In the single actuating mechanism, both ears are concurrently controlled and in the dual actuating mechanism, the ears are independently controlled.

Figure 4:
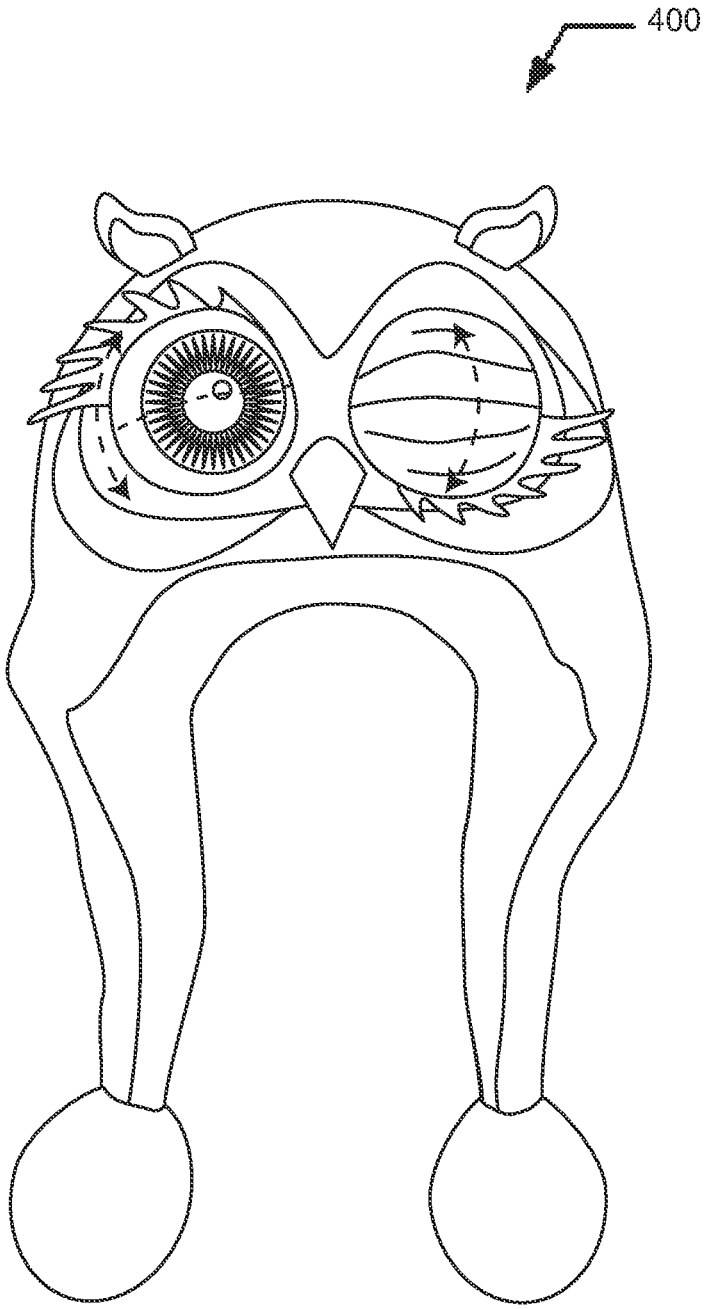
FIG. 4 illustrates an alternative active head covering including a second alternative thematic configuration.

FIG. 4 illustrates an alternative active head covering 400 including a second alternative thematic configuration. Active head covering 400 includes an owl theme with a pair of moveable elements configured as owl eyelids. The terminal portions may optionally be configured or depicted as owl talons. Active head covering 400 supports both a single actuating mechanism and a dual actuating mechanism arrangement for control of the owl eyelids in response to operation of actuating mechanisms deployed within one or both of the terminal portions. In the single actuating mechanism, both eyelids are concurrently controlled and in the dual actuating mechanism, the eyelids are independently controlled.

Figure 5:
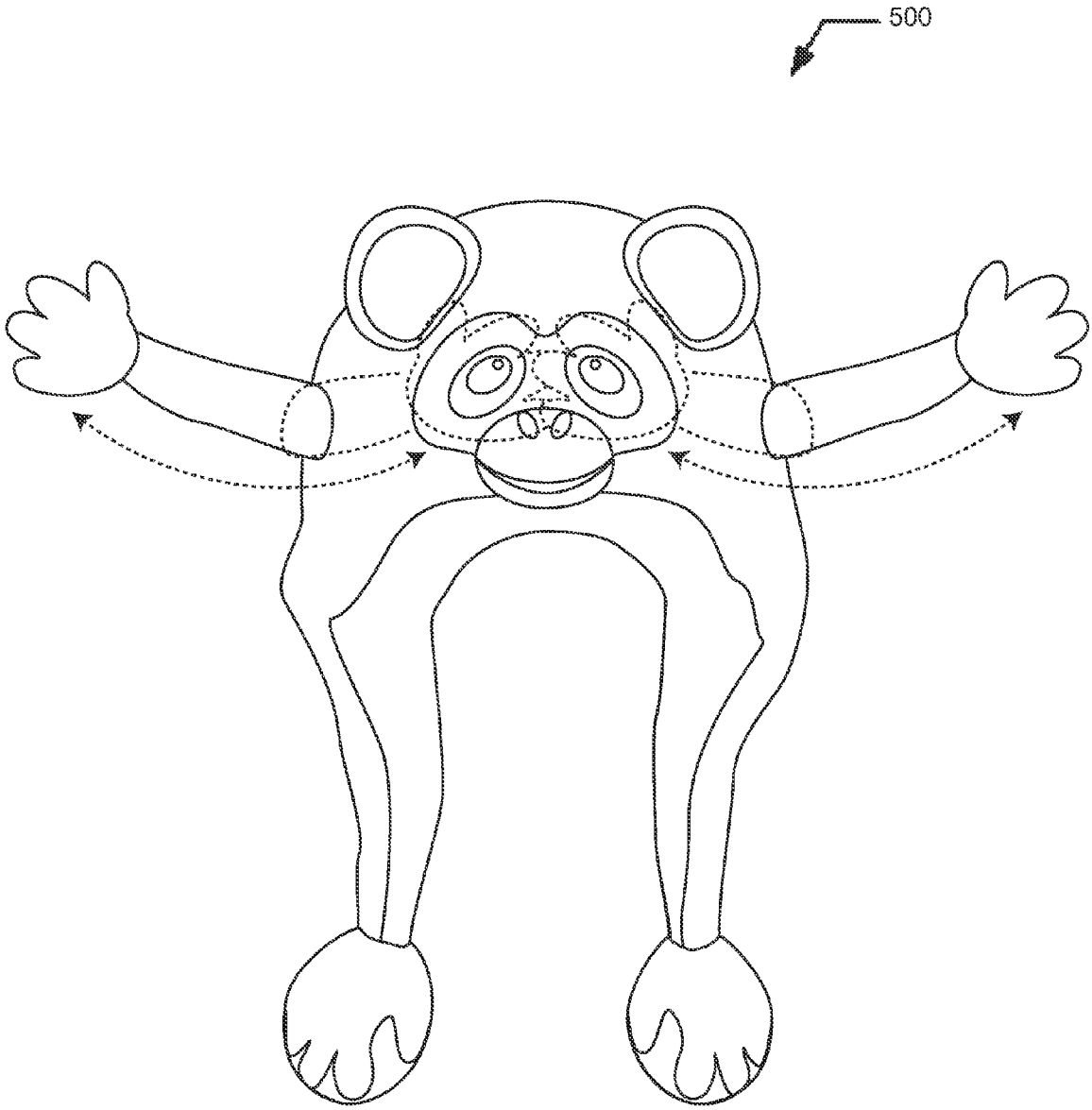
FIG. 5 illustrates an alternative active head covering including a third alternative thematic configuration.

FIG. 5 illustrates an alternative active head 500 covering including a third alternative thematic configuration. Active head covering 500 includes a monkey "see no evil" theme with a pair of moveable elements configured as monkey arms. The terminal portions include monkey feet. The monkey arms are positioned to open and close, alternatively revealing and covering eyes of the monkey. The remote actuators associated with active head covering 500 are configured to unfold and fold from a forward portion of the head portion and thus extend forward and laterally (as opposed to up and laterally as shown in FIG. 1-FIG. 4). Active head covering 500 supports both a single actuating mechanism and a dual actuating mechanism arrangement for control of the monkey arms in response to operation of actuating mechanisms deployed within one or both of the terminal portions. In the single actuating mechanism, both arms are concurrently controlled and in the dual actuating mechanism, the arms are independently controlled.

Figure 6:
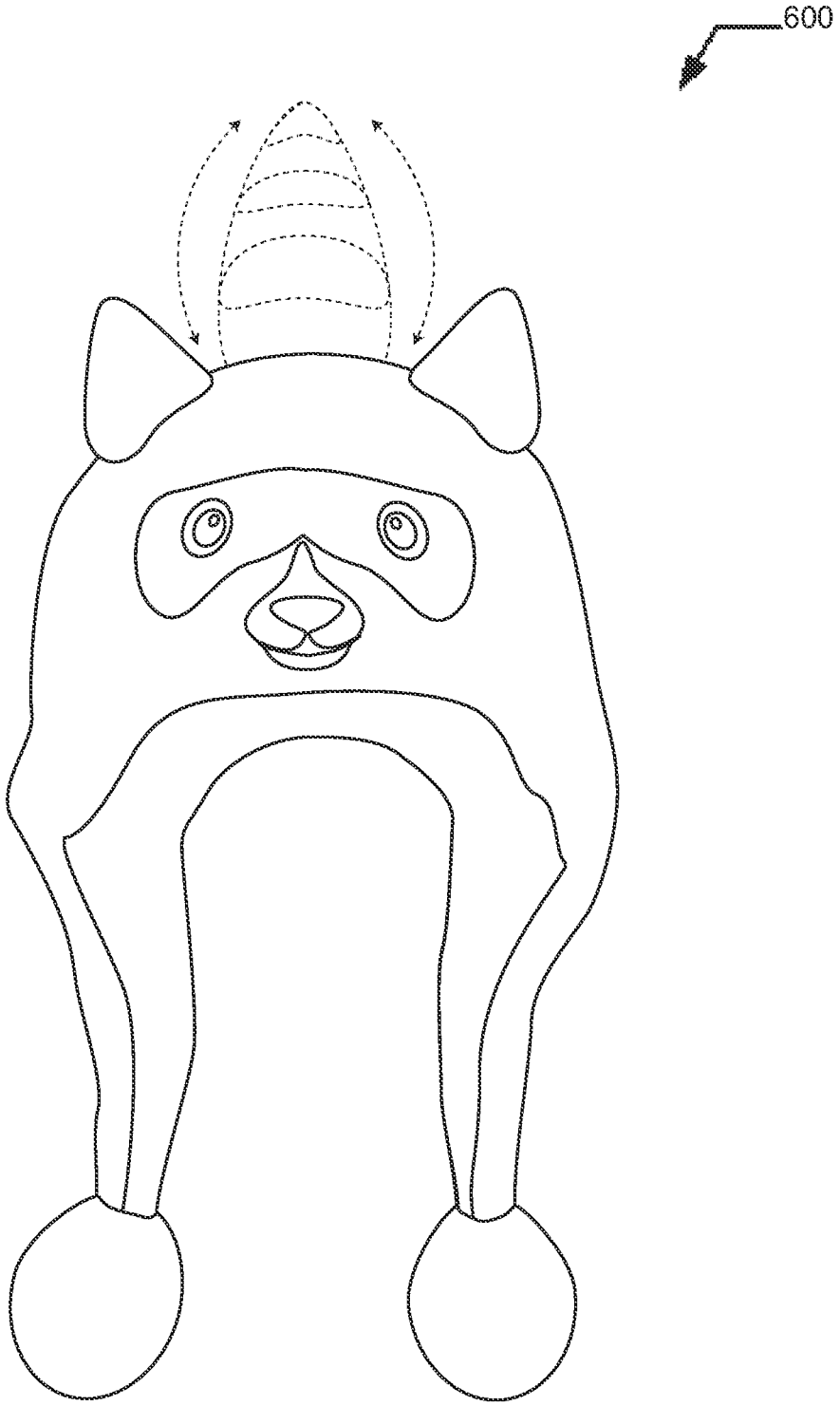
FIG. 6 illustrates an alternative active head covering including a fourth alternative thematic configuration.

FIG. 6 illustrates an alternative active head covering 600 including a fourth alternative thematic configuration. Active head covering 600 includes a raccoon theme with a single moveable element configured as a tail of the raccoon. The tail is attached to a rear of the head portion and lifts and falls in response to actuation/deactuation. The terminal portions may include raccoon paws. Active head covering 600 supports a single actuating mechanism arrangement for control of the tail in response to operation of actuating mechanism deployed within one of the terminal portions. In the illustrated embodiment, the tail is hinged at the head portion at a location that enables it to be seen from the front when actuated and to be hidden from view when deactuated.

Figure 7:
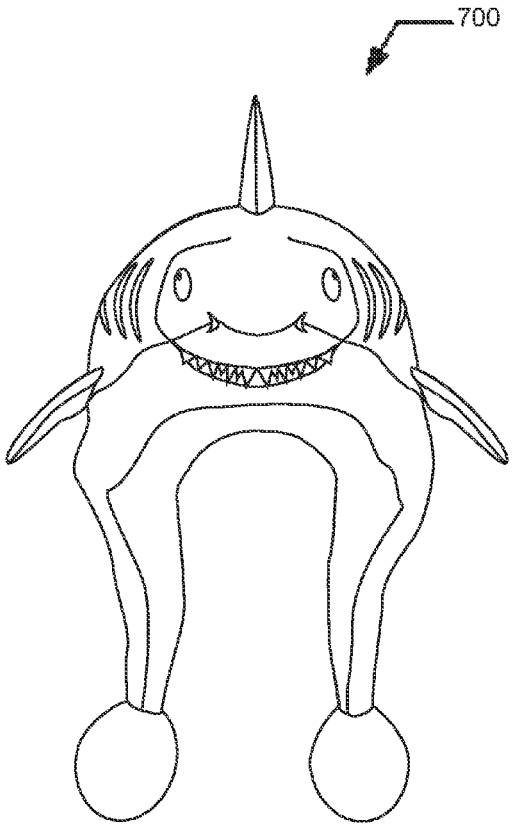
FIG. 7-8 illustrate an alternative active head covering including a fifth alternative thematic configuration.
Figure 8:
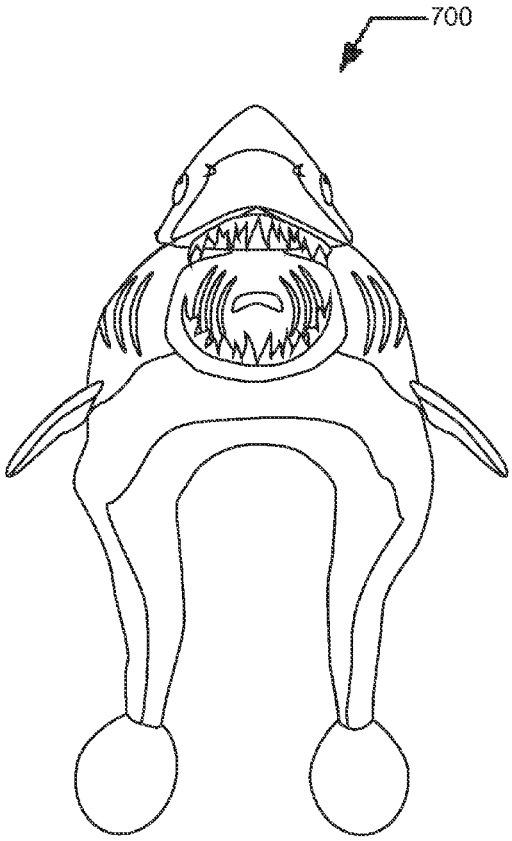

FIG. 7-8 illustrate an alternative active head covering 700 including a fifth alternative thematic configuration. FIG. 7 illustrates the alternative active head covering in an unactuated state; and FIG. 8 illustrates the alternative active head covering in an actuated state. Active head covering 700 includes a shark theme with a single moveable element configured as a jaw of the shark. The jaw is attached to a front of the head portion and opens (i.e., lifts) and closes (i.e., falls) in response to actuation/deactuation. The terminal portions may include shark fins. Active head covering 700 supports a single actuating mechanism arrangement for control of the jaw in response to operation of actuating mechanism deployed within one of the terminal portions.

Figure 9:
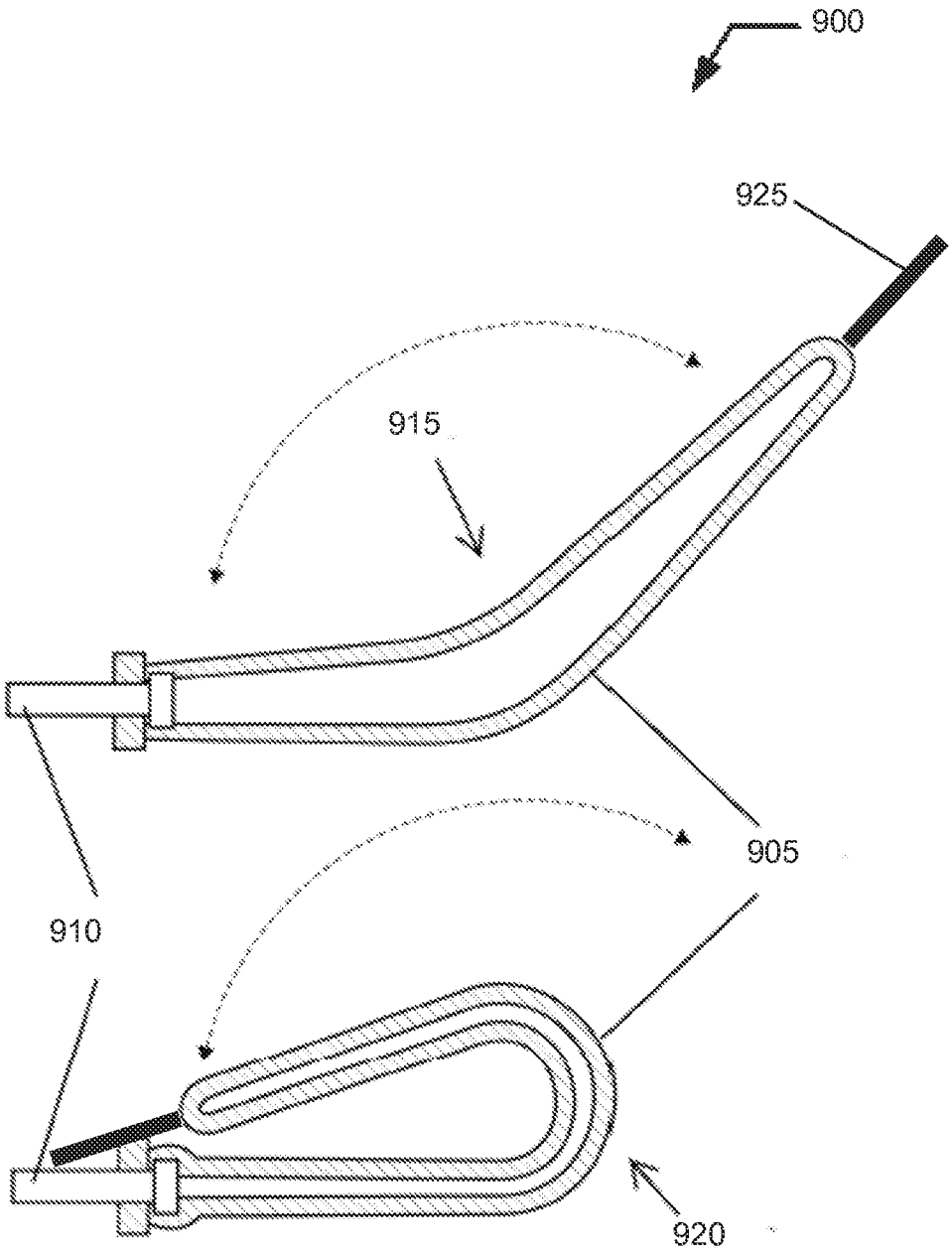
FIG. 9 illustrates a series of side elevation views of an operational sequence for a remote actuator for use with a themed fanciful air-powered active head covering described herein.

FIG. 9 illustrates a series of side elevation views of an operational sequence for a remote actuator 900 for use with a themed fanciful air-powered active head covering described herein. Remote actuator 900 may simulate one of a moveable element 125 (e.g., an expanding/contracting limb, appendage, growth, or door, hatch, portal, or the like). Remote actuator 900 includes a folding/unfolding balloon 905 that is soft and mounted to an actuating port 910. Remote actuator 900 opens (e.g., unfolds) when inflated to provide an extended structure 915 and closes (e.g., folds) when deflated to provide a retracted structure 920. Remote actuator 900 includes an optional extension member 925 that is non-inflating hard/rigid portion of balloon 905. In some implementations, dimensions of an active portion of balloon 905 may be relatively short. In order to move longer moveable elements, extension member 925 is used to leverage movement of balloon 905 to better support moveable elements that are longer than the active portion. Extension member 925 includes mounting holes to allow attachment of the sheath of moveable elements 125. In the preferred embodiment, extension member 925 is periodically scored along its length to enable its length to be easily shortened in reproducible predetermined lengths to best match needed lengths.

In some implementations, remote actuator 900 is manufactured of thermoplastic rubber (TPR), blown plastic, and other polymers that may have "memory" properties to be biased into the folded position. One advantage of TPR and other materials in this class is that they include better "memory" and may be stretched and expanded with reduced risk of compromising an integrity of balloon 905. In the case of remote actuators that include elastic, non-deforming expansions, the actuating mechanism may be calibrated to provide a different (e.g., increased) quantity of air as compared to an elastic deformable remote actuator. (For example, a deformable remote actuator would be one that includes an expandable/collapsible balloon that increased capacity as air flows in and decreases capacity as air exits.)

One advantage of remote actuator 900 is that it includes self-biasing features and no additional memory spring or the like is necessary to aid deflation when deactuating. Other embodiments may use variations of remote actuator 900 for actuating one or more of the moveable elements. Further, these elements may be constructed in many different ways. One variation for an inexpensive actuating active element includes a blow-molded bladder in which heat or the like is used to preform the bladder into a "memorized" configuration appropriate for an unactuated mode, similar in visualization to remote actuator 900. Air effects operating on such a bladder straightens it to an actuated mode which will automatically transition to the unactuated mode when the actuating air effect is released.

As illustrated in FIG. 9, remote actuator 900 includes a fixed portion (e.g., a proximal end nearest actuating port 910) attached to the article and a moving portion (e.g., a distal end at an end opposite of the proximal end) moveably coupled to the fixed portion by a fold region. In some implementations, the moving portion includes one or more additional folds to produce an extendable remote actuator, these optional additional folds may be inward or outward folds.

Figure 11:
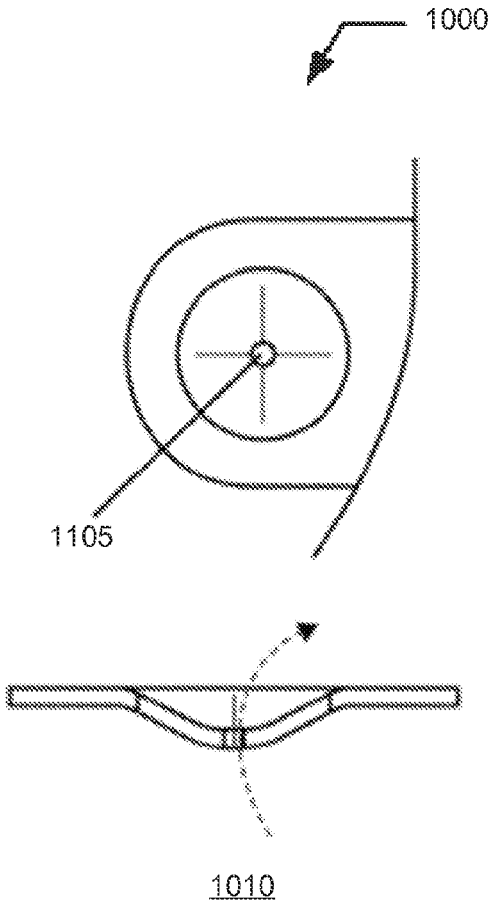
FIG. 10 and FIG. 11 illustrate a modified valve that includes an optional bleed mechanism.
Figure 10:
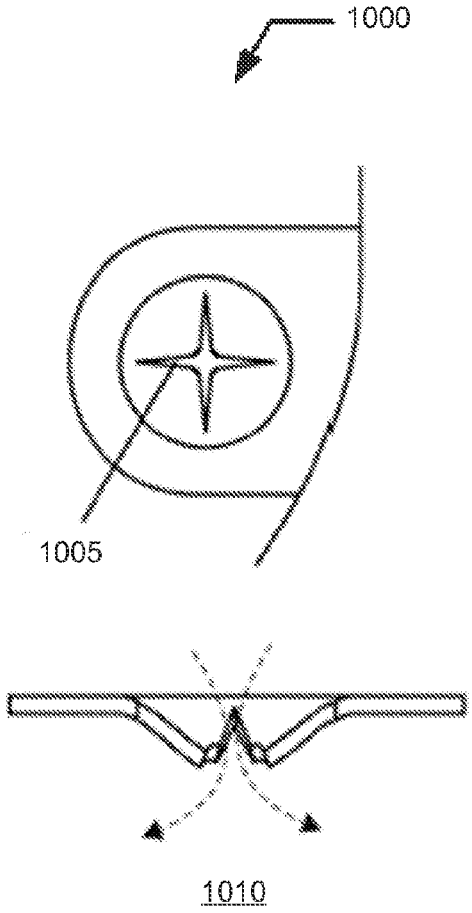

FIG. 10 and FIG. 11 illustrate a modified valve 1000 with a valving structure 1005 that includes an optional bleed mechanism 1105. FIG. 10 illustrates valve 1000 open an allowing air into an air reservoir 1010 and FIG. 11 illustrates valve 1000 closed with optional bleed mechanism 1105 bleeding air from air reservoir 1010. Air reservoir 1010 may include one or more of the actuating mechanism, the remote actuator, and/or the conduit coupling the elements together.

Valve 1000 may be a type of one-way valve, allowing quick intake and slow release of air into and out of reservoir 1010. Valve 1000 is, in a preferred embodiment, a simple cross-cut in a molded air-bladder. An optional small hole provides bleed mechanism 1105 coupled with the cross cut (for example placed at a bottom of a concave divot) to provide variable airflow control. Valve 1000 in the closed mode includes the optional small hole for slow release. Valve 1000 in an open mode has a larger aperture (e.g., open cross-cut) for increased air intake. In some implementations, valve 1000 may include a layer of open cell foam or other air-permeable material overlying the cross-cut to help produce a one-way valving effect.

Figure 12:
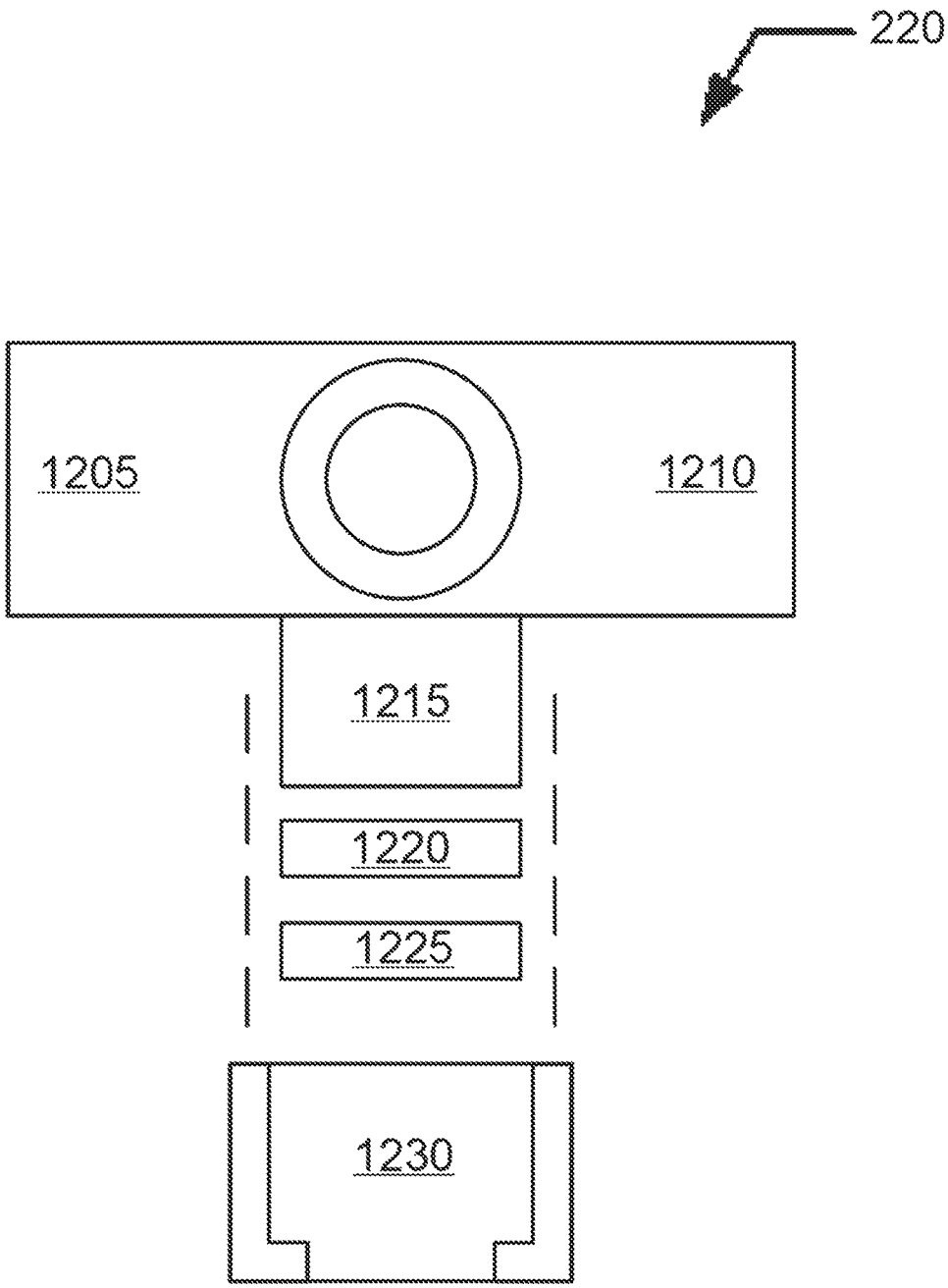
FIG. 12 illustrates an exploded view of the intake valve assembly shown in FIG. 2.

FIG. 12 illustrates an exploded view of intake valve assembly 220 that could be used in FIG. 2. Intake valve assembly 220 includes a first port 1205, a second port 1210, an aperture 1215, a fabric layer 1220, a rubber diaphragm 1225, and a cap 1230. Fabric layer 1220 permits air leakage/flow through refill mechanism 1030.

First port 1205 may be coupled to actuating mechanism 205 and second port 1210 may be coupled to conduit 215 as shown in FIG. 2. Airflow between first port 1205 and second port 1210 is two-way. Airflow from first port 1205 and aperture 1215 or second port 1210 and aperture 1215 is one-way (i.e., from the aperture to either of the ports). In some implementations, such as shown in FIG. 12, the construction of intake valve assembly 220 includes the bleed mechanism as described herein to allow fast intake and slow outflow of air with respect to ambient.

Figure 13:
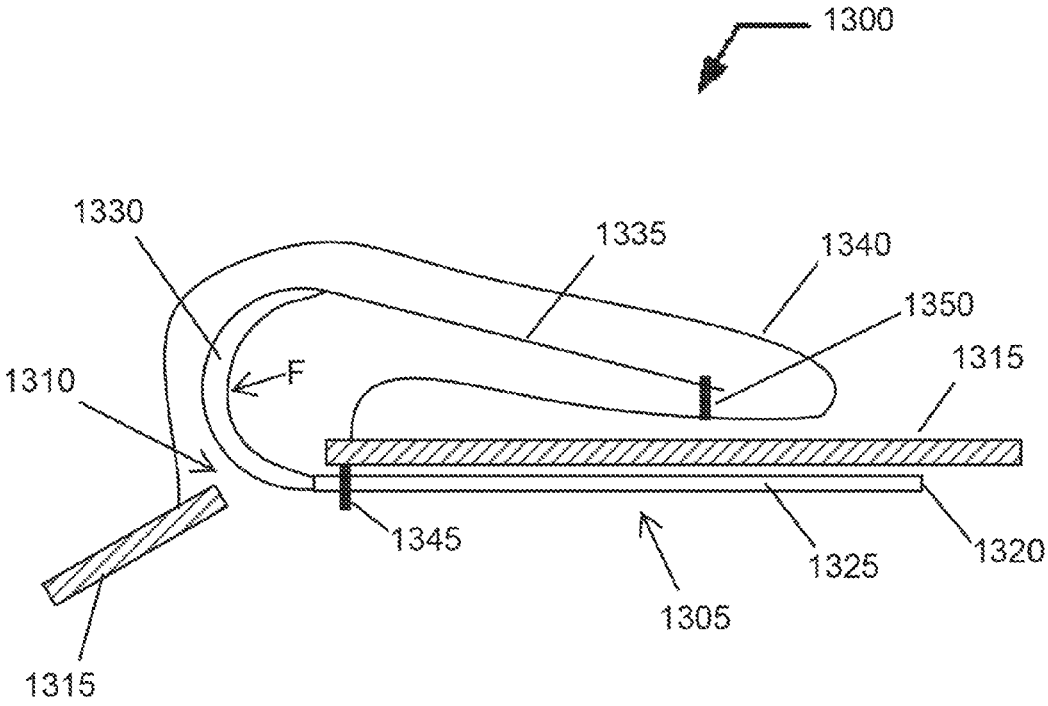
FIG. 13 illustrates a section of the active head covering where a remote actuator passes through an aperture in the outside layer of the head portion.

FIG. 13 illustrates a section 1300 of the active head covering described herein where a remote actuator 1305 passes through an aperture 1310 in an outside layer 1315 of the head portion. Remote actuator 1305 is a variation of remote actuator 900 in terms of arrangement, and except where the following content indicates otherwise, remote 1305 conforms to the structural and operational details associated with remote actuator 210 and remote actuator 900 described herein.

Remote actuator 1305 includes an actuating port 1320, a channel portion 1325, an actuating balloon portion 1330, and an extension portion 1335. A sheath 1340 encloses those portions of remote actuator 1305 outside of outside layer 1315. An actuator anchor attachment 1345 (e.g., anchor stitching, staples, tacks, and the like with stitching preferred) secures balloon portion 1330 into its desire orientation which is where folding and unfolding (e.g., fold region F) occur primarily and in the illustrated embodiments exclusively outside of outside layer 1315.

In this implementation, balloon portion 1330 begins at or near anchor attachment 1345 and is configured to curve up immediately into and through aperture 1310 to maximize folding/unfolding region outside of outside layer 1315. This inhibits/resists binding or obstruction of operation of remote actuator 1305.

A flapper anchor attachment 1350 is preferably positioned, for example by appropriate sizing of extension portion 1335, as close to a distal end of sheath 1340 as possible without degrading operation. Flapper anchor attachment 1350 helps to maintain fold region F in the desired position and resists relative shifting/motion of remote actuator 1305 as compared to aperture 1310.

Figure 14:
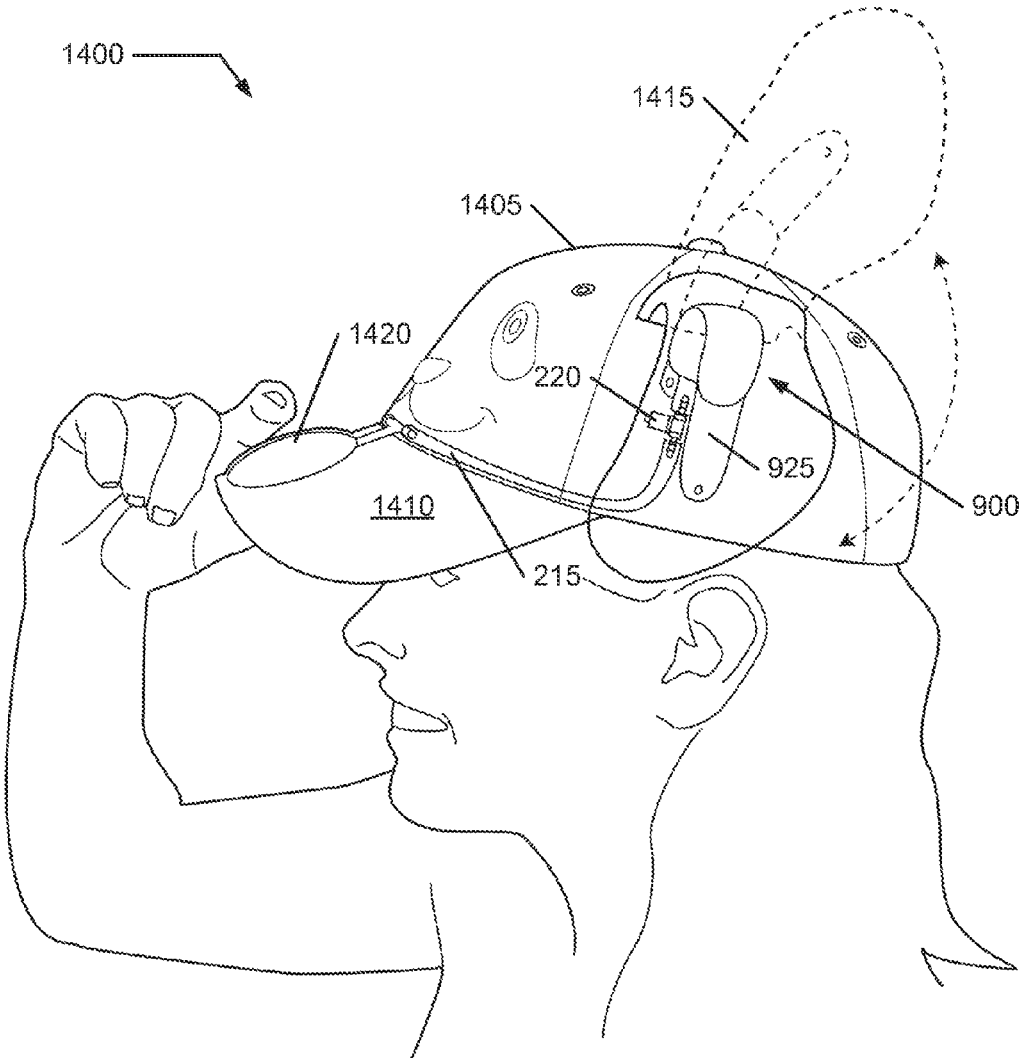
FIG. 14 illustrates a side elevation view of an alternate active head covering having one or more moveable elements arranged into a thematic configuration.

FIG. 14 illustrates a side elevation view of an alternate active head covering 1400 having one or more moveable elements arranged into a thematic configuration, in this case, a rabbit. Except as set forth herein, active head covering 1400 corresponds in form and function to active head covering 100 described herein with respect to FIG. 1-FIG. 13, and dispenses with the described side extensions. Active head covering 1400 of FIG. 14 is implemented as a cap, shown as a baseball cap style that includes a soft cap 1405 with a rounded crown and a bill 1410 projecting in front, though other cap implementations are possible, such as a "knit" soft cap without bill 1410. The front of soft cap 1405 contains designs or thematic elements consistent with the thematic theme. As illustrated, the design is of the face of the rabbit. The back of the cap may be "fitted" to the wearer's head size or it may have a plastic, hook and loop, elastic, or other adjuster so that it can be quickly adjusted to fit different wearers.

Soft cap 1405 is constructed of an outside shell having a single layer though it may be constructed of at least two layers including the outside shell and an inside liner. Active head covering 1400 may be sewn in six sections, and may be topped with a matching fabric-covered button on a crown of soft cap 1405. Metal grommets or fabric eyelets may be sewn or attached near the top of each of the six sections of fabric to provide ventilation. In some cases, one or more rear sections of the crown are made of net-like mesh material. Bill 1410 is typically stiffened by a sewn-in piece of paperboard and covered, though other materials may be used.

The materials used in the implementations may be natural or synthetic fabric of virtually any type with the disclosed embodiments including one or more outer/visible components being of plush construction. Plush, in this context refers to natural (e.g., mohair, worsted yarn, silk) or synthetic (e.g., polyester) fibers and may include a filler or "stuffing" between the outside shell and the inside liner. One configuration includes the outside shell having acrylic knit material and the inside liner (stitched to the outside shell) including fleece. In some implementations, soft cap 1405 is "stretchable" and allows for a "one size" fits all implementation, which means that it is form-fitting in most cases. In some implementations, the inside layer does not completely match the inside of soft cap 1405 leaving some of the inside uncovered. Other implementations may dispense with the inside layer completely. Such implementations may not conceal some or all of the actuating components, or the actuating components may be integrated or concealed in some other fashion, such as integrating air channels inside the outside layer. In some implementations, soft cap 1405 may actually be implanted as a rigid or semi rigid shell structure and need not be soft and/or flexible. Some or all of the components (e.g., cap, bill, moveable elements, and the like) may be made of foam elements.

As described herein, active head covering 1400 includes one or more user-controlled moveable elements. There is a wide range of different sizes and weights associated with these moveable elements. In some implementations, it may be desirable for soft cap 1405 to be securely associated with the head to achieve desired results and effects associated with moving these elements. In some embodiments, soft cap 1405 includes an elastomer yarn or thread and is designed to fit snug on the head. In some embodiments, a strap or the like may be used to help active head covering 1400 in place.

In these embodiments, a thematic configuration is often set for active head covering 1400, such as a particular animal, fanciful creature, or the like. One or more moveable elements 1415 are configured to further support and extend the theme, such as by providing moving limbs, anatomical structures, and the like (e.g., a pair of moveable rabbit ears, one of which is shown in FIG. 14). Preferably some component, element, or structure of active head covering 1400 (e.g., bill 1410) hides an actuating mechanism 1420 used to manipulate the one or more moveable elements 1415. In a baseball cap style type of implementation, it is common to provide a single actuating mechanism symmetrically centered with respect to bill 1410, though some implementations may provide one or more actuating mechanisms distributed on/embedded in soft cap 1405, such as a single rearward and upward actuating "tail" or other member, or some other single moveable element that is consistent with the thematic elements.

Active head covering 1400 includes one or two moveable elements disposed on soft cap 1405 and one actuating mechanism 1420 on bill 1410. Some implementations provide that two moveable elements 1415 may be independently controlled by two independent actuating mechanisms 1420 while other implementations, such as that illustrated in FIG. 14, include the two moveable elements 1415 controlled concurrently by the same single actuating mechanism 1420. This principle may be extended to more than two moveable elements with a first set controlled by a first actuating mechanism and a second set controlled by a second actuating mechanism.

Moveable elements 1415 are external thematic elements that respond to the actuating mechanisms to tilt, lift, unfold, expand, extend, rotate, flap, open, or otherwise move to a first configuration when one or more actuating mechanisms 1420 are operated. Moveable elements 1415 are biased to an untilted, dropped, folded, contracted, withdrawn, unrotated, closed, or otherwise motionless second configuration. Manual operation of actuating mechanism 1420 in bill 1410 overcomes the bias to transition an effected moveable element 1415 from the second configuration to the first configuration. As further explained herein, moveable element 1415, being biased to the second configuration, automatically transitions from the first configuration to the second configuration after a period.

Moveable elements 1415 contain concealed actuators that are covered by material (e.g., cloth, plush, other fabric, plastic, rubber, and the like) that may be opaque, translucent, transparent or a combination of these properties. Some moveable elements 1415 include a first portion that is visible in both the first configuration and in the second configuration and a second portion only visible in the first configuration similar to the arrangement of moveable elements in FIG. 1.

Moveable elements 1415 of FIG. 14 are configured to lift laterally, but are not required to do so. A relative motion between moveable element 1415 and soft cap 1405 is determined by the type of internal actuator included within moveable element 1415 and the arrangement and specifics of an attachment configuration of moveable element 1415 to soft cap 1405, including any hinging coupling that physically connects moveable element 1415 to soft cap 1405. Some moveable elements 1415 may move laterally, frontally, rearwardly, side-to-side, bottom-to-top, diagonally, or a combination thereof. In some instances, the concealed actuator within moveable element 1415 may have a complex motion.

Moveable elements 1415 are actuated and controlled responsive an actuating system as described herein, for example in FIG. 2. Some implementations may dispose actuating mechanism 1420 in a brim portion other than bill 1410, or may be disposed on another portion (e.g., a top, side, or back) of soft cap 1405. The actuators are preferably covered/concealed but some implementations may configure the actuators to be visible at least during some portion of operation. Some implementations of active head covering 1400 lack bill 1410 and therefore actuating mechanism 1420 is disposed in or on some other structure of active head covering 1400, such as a front or side area of soft cap 1405.

Figure 15:
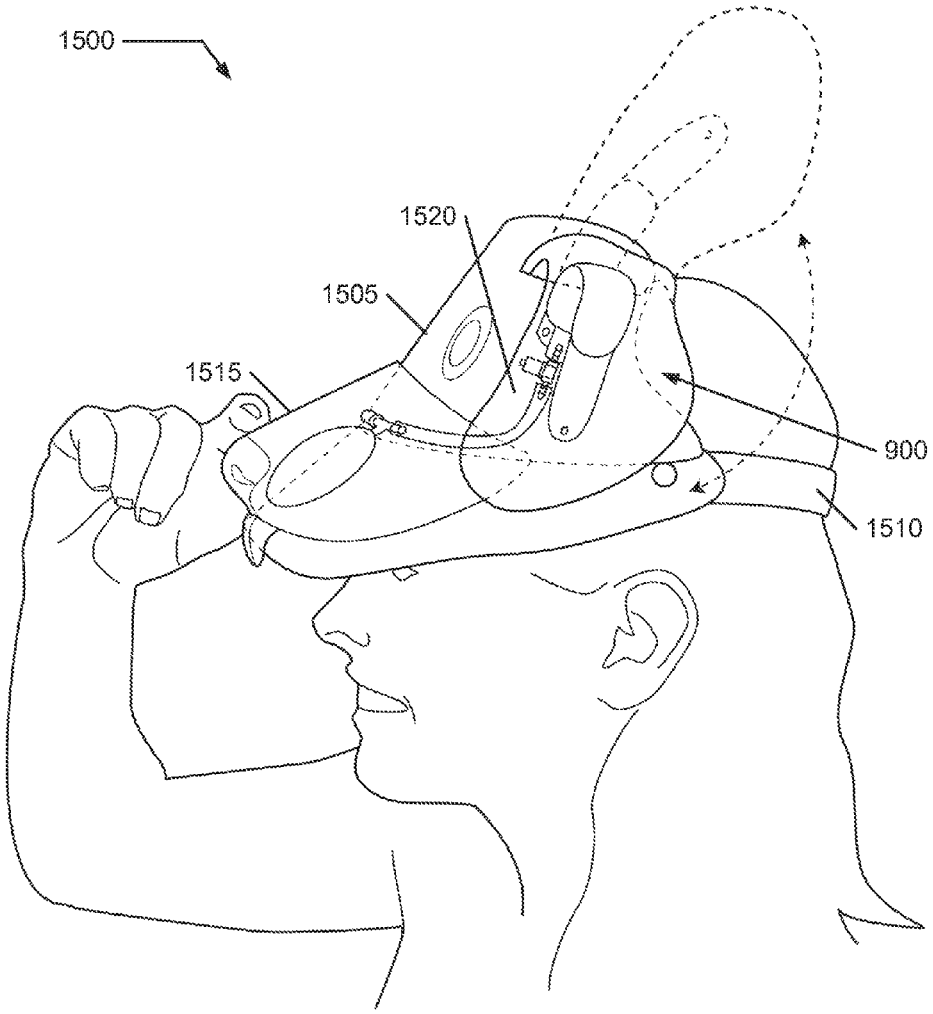
FIG. 15 illustrates a side elevation view of an alternate active head covering having one or more moveable elements arranged into a thematic configuration.

FIG. 15 illustrates a side elevation view of an alternate active head covering 1500 having one or more moveable elements arranged into a thematic configuration. Covering 1500 is configured, and operates similarly to, covering 1400 while including the following changes. Covering 1500 is implemented as a visor-type head covering in which a front portion 1505 is secured to a head using a band 1510 or other functionally equivalent structure. An optional bill 1515 extends from front portion 1505. Some or all of the head is thus exposed. One or more moveable elements 1520 are moveably coupled to a component of covering 1500, the motion controlled by the actuating system (e.g., actuator 900) with the actuating mechanism 1420 located remote from the one or more actuators that are associated with the one or more moveable elements 1520. (Solid lines for moveable element 1520 illustrate the unactuated position or mode and dashed lines illustrate an actuated position or mode.)

Front portion 1505 may be made of the same materials as soft cap 1405. The actuating mechanism 1420 may be attached to, or embedded within, optional bill 1515 when present. Otherwise actuating mechanism 1420 is attached to, or embedded within, some other component of covering 1500, such as front portion 1505 or band 1510, for example. In some embodiments, front portion 1505 may include a unitary or multicomponent assembly that may be shaped, formed, molded or otherwise produced to include a three-dimensional representation of a face (or portions thereof) of a person, animal, or fantasy construct or imagining. For example, front portion 1505 is shown visualized as a representation of a dog face, with a bunny/rabbit face, cat/feline, monkey/primate, chicken/fowl, bear, owl/bird, raccoon, shark/fish, or other creature, real or imaginary.

The capacities of the air volumes and rates of inflow and bleeding are tuned to achieve the level of responsiveness in actuating the moveable elements. A relative volume of air between the actuating mechanism and the controlled remote actuators, along with a distance between the structures influences a magnitude of motion (e.g., how much unfolding). How quickly the refill assembly is able to refill the actuating mechanism helps influence how quickly the user is able to repeat a motion of a moveable element. It is important that the bleed mechanism not be so large as to interfere with unfolding or so small that the moveable elements are "locked" in the unfolded configuration.

The actuating components have been described in terms of hydraulic systems that employ air. Other systems may employ a fluid for actuation using a closed system lacking bleed mechanisms. In other variations, mechanical linkages and/or levers may be used in place of one or more of the actuating components. For example a lever may operate an air-powered actuating mechanism, or the bellows-type actuating mechanism may trigger a mechanical remote actuator that employs levers and springs to move the moveable elements. In mechanical or hybrid mechanical-hydraulic systems, a moveable flexible cable may couple the actuating mechanism to the remote actuator.

While the embodiments illustrated in the figures include head coverings with side extensions, some implementations of the present invention will not include any side extension. In such cases, there may be other structures for concealing the actuating mechanism and/or part of the conduit. However, some embodiments may include one or more unconcealed actuating components, whether it be the actuating mechanism, conduit, or remote actuator. For implementations without a side extension, some devices may locate the actuating mechanism in or on some other structure, such as a bill or brim of a hat, or other hat component.

The illustrated embodiments have been described in terms of use of non-deformable balloon actuators which use flexible but inelastic layers to form the actuating balloon. In some implementations, the actuating balloon may be both flexible and elastic forming deformable balloon actuators that "inflate" and "deflate" in response to actuating air. In both cases there is some degree of inflation but the elastic walls of the deformable implementation stretch and grow whereas the walls of the deformable implementation do not stretch. The parent application includes descriptions of these types of actuators which may be employed in the present invention.

The system and methods above have been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. An active head covering, comprising:

a head portion having an outside layer defining a head cavity therewithin; and an actuator assembly coupled to said head portion, said actuator assembly including:

a first actuating mechanism, said first actuating mechanism having a bulb defining a first actuating volume containing a first quantity of air, said bulb repeatably collapsible to expel a portion of said first quantity of air through a first actuating port of said bulb, said bulb automatically expanding to refill said first actuating volume;

a first remote actuator forming an actuating balloon defining a second actuating volume accessible through a second actuating port, said first remote actuator having a fixed portion foldably coupled to a moving portion at a fold region with said moving portion at least partially overlapping said fixed portion defining a folded configuration, said fixed portion coupled to said outer layer with said fold region and said moving portion both disposed outside of said head cavity portion, said first remote actuator unfolding about said fold region from said folded configuration in response to said portion of said first quantity of air expelled from said first actuating port with said moving portion moving away from said fixed portion and said first remote actuator folding about said fold region in response to air exiting from said second actuating volume, said first remote actuator biased to said folded configuration; and an air communication channel coupled to said first actuating port of said first actuating mechanism and coupled to said second actuating port of said first remote actuator.

2. The active head covering of claim 1 wherein said actuator assembly further includes an intake valve assembly including a first port, a second port, and a third port, said intake valve assembly providing a two-way airflow channel between said first port and said second port and a one-way airflow channel between said third port and said other ports, said one-way airflow channel communicating air from ambient to said two-way channel wherein said two-way airflow channel is installed within said air communication channel.

3. The active head covering of claim 2 wherein said first port is coupled to said first actuating port and wherein said air communication channel includes a conduit coupled to said second port and coupled to said second actuating port.

4. The active head covering of claim 1 further comprising a bleed valve operatively coupled to said air communication channel.

5. The active head covering of claim 4 wherein said bleed valve is disposed in said actuating balloon.

6. The active head covering of claim 4 wherein said bleed valve is disposed in said first actuating volume.

7. The active head covering of claim 4 wherein said bleed valve is disposed in said air communication channel.

8. The active head covering of claim 1 further comprising a bleed valve operatively coupled to said air communication channel.

9. The active head covering of claim 8 wherein said bleed valve is disposed in said intake valve assembly.

10. The active head covering of claim 1 wherein said actuating balloon includes a bladder having a bladder wall containing said second actuating volume and further includes a pair of flexible layers as opposing portions of said bladder wall.

11. The active head covering of claim 10 wherein said pair of flexible layers are independent overlaying layers including a seal around a common perimeter of said pair of flexible layers.

12. The active covering of claim 1 wherein said fixed portion is disposed outside said head cavity and coupled to an outside of said outer layer.

13. The active head covering of claim 1 wherein said outer layer includes an aperture, wherein said fixed portion is disposed inside said head cavity, and wherein said first remote actuator extends through said aperture.

14. The active head covering of claim 13 wherein said fixed portion includes an anchor attachment proximate said aperture configured to fix said fold region outside said head cavity at a non-binding location.

15. The active head covering of claim 1 wherein one or more of said portions of said first remote actuator extend outside said outer layer as a set of outside extending portions, and further comprising a flexible sheath coupled to an outside of said outside layer, said flexible sheath concealing said set of outside extending portions.

16. The active head covering of claim 14 wherein one or more of said portions of said first remote actuator extend outside said outer layer as a set of outside extending portions, and further comprising a flexible sheath coupled to an outside of said outside layer, said flexible sheath concealing said set of outside extending portions.

17. The active head covering of claim 15 wherein said moving portion of said first remote actuator includes a distal end opposite of said second actuating port and wherein said distal end includes an anchor attachment coupled to said flexible sheath that fixes said fold region outside said outside layer.

18. The active head covering of claim 1 wherein said actuator assembly is configured as a unitary discrete assembly.

19. The active head covering of claim 1 wherein said actuator assembly further includes a second remote actuator configured like said first remote actuator, wherein said air communication channel is coupled to said actuating port of said second remote actuator, and wherein said first actuating mechanism concurrently operates both said first remote actuator and said second remote actuator.

20. The active head covering of claim 1 wherein said actuator assembly further includes a second actuating mechanism configured like said first actuating mechanism and a second remote actuator configured like said first remote actuator and a second air communication channel coupling said second actuating mechanism to said second remote actuator, wherein said first actuating mechanism operates said first remote actuator without operating said second remote actuator, and wherein said second actuating mechanism operates said second remote actuator without operating said first remote actuator.

21. The active head covering of claim 1 further comprising a bill coupled to, and extending outward from, said head portion.

22. The active head covering of claim 21 wherein said first actuating mechanism is coupled to said bill.

23. An active head covering, comprising:

a visor portion having a front portion and a securing system coupled to said front portion configured to secure said visor portion to a head of a wearer, said visor portion and said securing system defining a head cavity therewithin; and an actuator assembly coupled to said visor portion, said actuator assembly including:

a first actuating mechanism, said first actuating mechanism having a bulb defining a first actuating volume containing a first quantity of air, said bulb repeatably collapsible to expel a portion of said first quantity of air through a first actuating port of said bulb, said bulb automatically expanding to refill said first actuating volume;

a first remote actuator forming an actuating balloon defining a second actuating volume accessible through a second actuating port, said first remote actuator having a fixed portion foldably coupled to a moving portion at a fold region with said moving portion at least partially overlapping said fixed portion defining a folded configuration, said fixed portion coupled to said outer layer with said fold region and said moving portion both disposed outside of said head cavity portion, said first remote actuator unfolding about said fold region from said folded configuration in response to said portion of said first quantity of air expelled from said first actuating port with said moving portion moving away from said fixed portion and said first remote actuator folding about said fold region in response to air exiting from said second actuating volume, said first remote actuator biased to said folded configuration; and an air communication channel coupled to said first actuating port of said first actuating mechanism and coupled to said second actuating port of said first remote actuator.

24. The active head covering of claim 23 wherein said visor portion further comprises a bill.

25. The active head covering of claim 24 wherein said actuating mechanism is coupled to said bill.

* * * * *